United States Patent [19]

West

[11] Patent Number: 5,014,493

[45] Date of Patent: May 14, 1991

[54] FORM-FILL-SEAL PACKAGING

[75] Inventor: George A. West, Mound, Minn.

[73] Assignee: Bemis Company, Inc., Minneapolis, Minn.

[21] Appl. No.: 347,079

[22] Filed: May 5, 1989

Related U.S. Application Data

[63] Continuation-in-part of Ser. No. 204,081, Jun. 8, 1988, abandoned.

[51] Int. Cl.[5] ..... B65B 9/20; B65B 61/00; B65B 1/36; B65B 1/40

[52] U.S. Cl. ..... 53/410; 53/451; 53/55; 53/503; 53/64; 53/552; 53/128.1

[58] Field of Search ..... 53/552, 551, 554, 451, 53/128, 129, 137, 410, 415, 503, 66, 51, 502, 64, 55

[56] References Cited

U.S. PATENT DOCUMENTS

| | | | |
|---|---|---|---|
| 2,852,898 | 9/1958 | Berg | 53/182 |
| 2,969,628 | 1/1961 | Irmscher | 53/551 X |
| 3,020,689 | 2/1962 | Luther | 53/140 |
| 3,052,074 | 9/1962 | Dreeben | 53/182 |
| 3,256,673 | 6/1966 | Tew et al. | 53/551 |
| 3,262,244 | 7/1966 | Cutler et al. | 53/551 |
| 3,335,540 | 8/1967 | Reil et al. | 53/28 |
| 3,482,373 | 12/1969 | Morris | 53/112 |
| 3,738,080 | 6/1973 | Reil | 53/551 |
| 3,820,691 | 6/1974 | Saur | 53/551 X |
| 3,879,917 | 4/1975 | Bassendale et al. | 53/28 |
| 4,241,563 | 12/1980 | Müller et al. | 53/511 |
| 4,288,965 | 3/1985 | James | 53/451 |
| 4,546,596 | 10/1985 | Cherney | 53/451 |
| 4,587,795 | 5/1986 | Yamashita | 53/554 X |
| 4,589,247 | 5/1986 | Tsuruta et al. | 53/551 X |
| 4,597,240 | 7/1986 | Scully | 53/57 |
| 4,656,818 | 4/1987 | Shimoyama et al. | 53/551 |
| 4,662,978 | 5/1987 | Oki | 53/551 X |
| 4,709,528 | 12/1987 | Merkus | 53/128 |
| 4,726,171 | 2/1988 | Kreager et al. | 53/410 |
| 4,729,210 | 3/1988 | Galliano | 53/441 |
| 4,750,534 | 6/1988 | Hirasawa et al. | 53/551 X |

*Primary Examiner*—Horace M. Culver

*Attorney, Agent, or Firm*—Senniger, Powers, Leavitt & Roedel

[57] ABSTRACT

Vertical form-fill-seal packaging of a fluent product, such as flour, wherein flexible packaging material is formed into tubing around a downwardly extending mandrel, the tubing is intermittently fed downwardly in package length increments off the lower end of the mandrel with a dwell between each successive feed, the tubing is transversely sealed at a level below the lower end of the mandrel during each dwell to form a top seal for a package being completed and a bottom seal for the next package, the tubing is severed between each top and bottom seal during each dwell, product being fed downwardly from the mandrel into the portion of the tubing, sealed at the bottom, being fed off the lower end of the mandrel, wherein the downward feed of the tubing and the feed of the product are such as substantially to fill the volume of the said portion of the tubing created by the downward feed of the tubing.

36 Claims, 15 Drawing Sheets

TIME ELAPSED IN SECONDS
AUGER
BACK SEAM SEAL
PULL BELTS
STAGERS
JAWS
SEALING BARS
0
0.5
1.0
1.5
2.0
2.5
3.0
3.5
4.0
30
15
41
10
J1, J2
B1, B2

T
13
30
30T
71
72
51
17
L
14
12

17
21
T
13
10
102a
102
100
C
24
L1
L3
51
12

FORM-FILL-SEAL PACKAGING

CROSS-REFERENCE TO RELATED APPLICATION

This application is a continuation-in-part of my copending coassigned U.S. patent application Ser. No. 204,081 filed June 8, 1988, (now abandoned) entitled Form-Fill-Seal Packaging.

BACKGROUND OF THE INVENTION

This invention relates to form-fill-seal packaging, particularly to the form-fill-seal packaging of fluent products, either fluent solid products (e.g., pulverlent products or liquids), and is especially concerned with the form-fill-seal packaging of powdery products and specifically the bagging by a form-fill-seal technique of products such as flour.

Packaging, e.g. bagging, of powdery products such as flour presents special problems because of the tendency of the product to emit dust, particularly if its delivery to the package involves any substantial free fall or "stringing out" of the product such as may cause aeration of the product and emission of dust as the product is delivered to the package (bag). This problem has heretofore been present in the packaging (bagging) of powdery products utilizing a vertical form-fill-seal machine in which the product is fed by an auger into each package (bag) being formed because the product, even though auger fed, is allowed to free fall into the lower end of the tubing of packaging material formed by the machine, causing aeration of the product and emission of dust.

Accordingly,, among the several objects of this invention may be noted the provision of improved methods of and apparatus utilizing the form-fill-seal technique for producing filled and sealed packages of fluent products; the provision of such methods and apparatus for producing filled and sealed packages (bags) of powdery product such as flour with relatively accurate filling at a relatively rapid rate and without undue interruption despite the dust-emitting proclivity of the product and the backward air pressure when a charge of product is introduced into an open mouth bag; the provision of such a method and apparatus utilizing a high-speed vertical form-fill-seal packaging machine with augering of the product into the lower end of the tubing of packaging material formed by the machine, and advantageously substantially maintaining the compaction of the product achieved by augering; the provision of such a method and apparatus utilizing a high-speed vertical form-fill-seal packaging machine with premeasurement of the fill or charge for each package; the provision of such methods and apparatus wherein the fill can be relatively readily changed and/or corrected to achieve a target net weight for each bag; and the provision of such methods and apparatus wherein air is vented from the bags and air entrapped in the fluent product is allowed to vent without undue escape of product or ingress of insects.

In carrying out the method of the invention for packaging fluent products in general (either fluent solid products or liquids), a web of flexible packaging material is formed into tubing around a downwardly extending mandrel, the tubing is intermittently fed downwardly in package length increments off the lower end of the mandrel with a dwell between each successive feed, the tubing is transversely sealed at a level below the lower end of the mandrel during each dwell to form a top seal for a package being completed and a bottom seal for the next package, the tubing is severed between each top and bottom seal during each dwell, product being fed downwardly into the portion of the tubing, sealed at the bottom, being fed off the lower end of the mandrel, in accordance with prior form-fill-seal packaging technique, but with what may be referred to as a bottom-up-fill technique involving the downward feed of the tubing and the feed of the product at predetermined rates so related so substantially to fill the volume of the said newly created volume portion of the tubing created by the downward feed of the tubing. Thus, as a certain volume of the tubing is created at its lower end as it is fed downwardly off the lower end of the mandrel, a corresponding volume of product is delivered to fill that volume, the product feed being continued until the desired volume and level of fill relative to the final package are achieved.

Apparatus of the invention correspondingly comprises a downwardly extending mandrel; means for forming a web of flexible packaging material into tubing around the mandrel; means for intermittently feeding the tubing downwardly in package length increments off the lower end of the mandrel at a predetermined rate of feed with a dwell between each successive feed; means for transversely sealing the tubing at a level below the lower end of each mandrel during each dwell to form a top seal for a package being completed and a bottom seal for the next package; means for severing the tubing between each top and bottom seal during each dwell; and means for feeding product downwardly into the portion of the tubing which is sealed at the bottom and being fed off the lower end of the mandrel with the product feed at a predetermined rate so related to the rate of feed of the tubing as substantially to fill the volume of said portion of the tubing created by the downward feed of the tubing, and continuing the product feed until the desired volume and level of fill relative to the first package length are achieved.

In one aspect of the invention, the product is augered into the lower end of the tubing. In another, the premeasured charge of product is dispensed from a supply and held for delivery from a valved delivery means on the ensuing downfeed of the tubing.

Additional features of the invention involve the provision of each bag with air vent means for venting of air from the bag and deflation of each bag as it is formed, these features also being applicable to vertical form, fill and seal operations and apparatus in general.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 13:
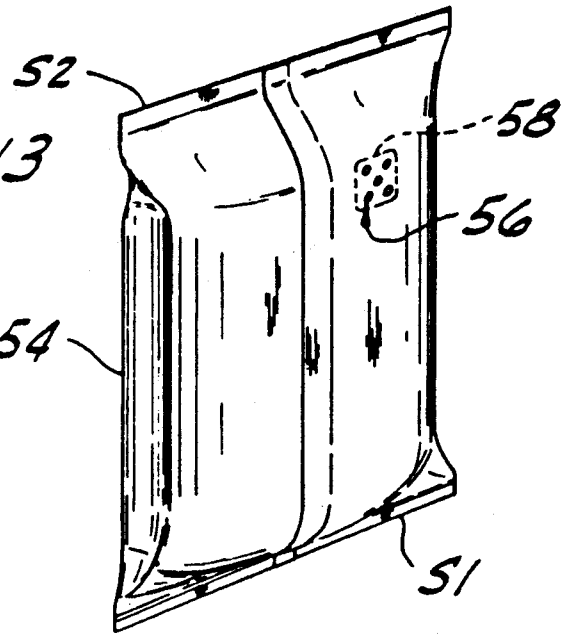
FIG. 13 is a perspective of a bag formed by the apparatus showing the air vent means with which the bag is provided.
Figure 12:
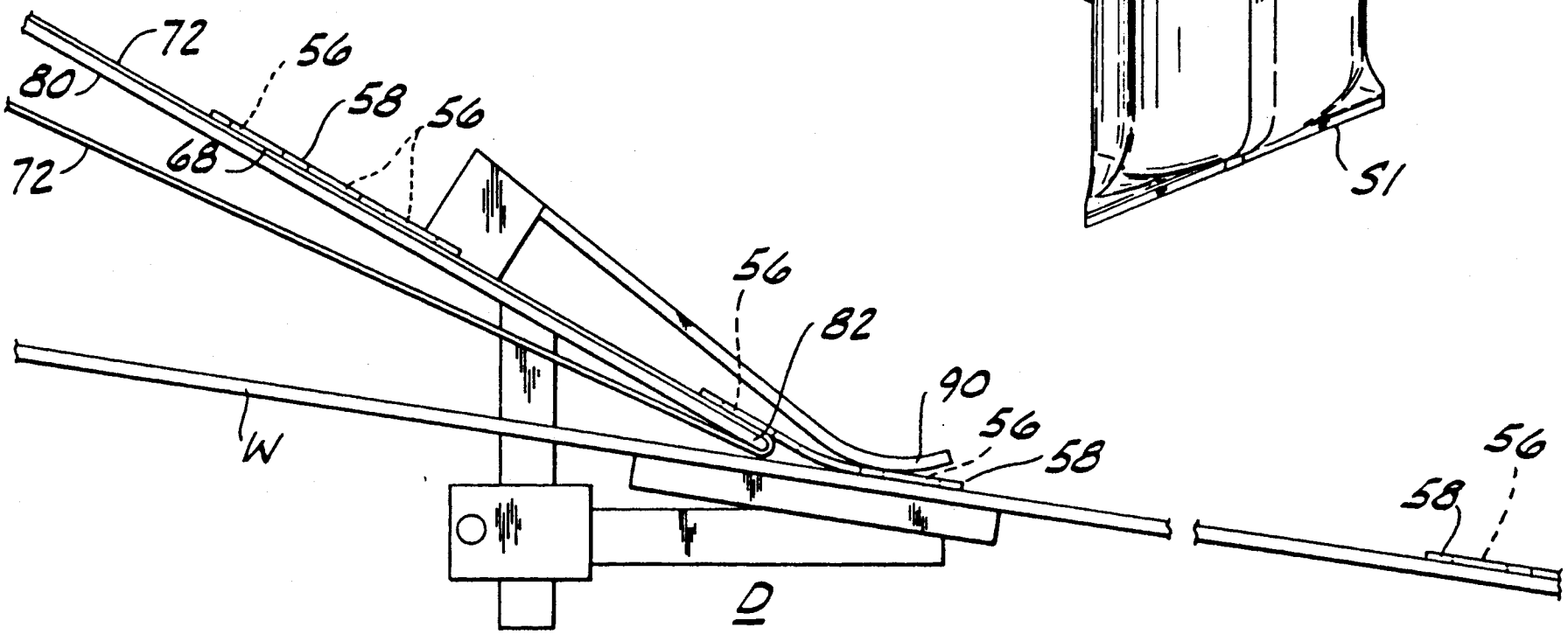
FIG. 12 is a view in side elevation of the FIG. 11 means.

Referring to FIGS. 1–8 of the drawings, apparatus of this invention for the form-fill-seal packaging of powdery products, such as flour, is shown to comprise a vertical form, fill, seal ("VFFS") machine designated in its entirety by the reference numeral 1, preferably one such as shown in the James U.S. Pat. No. 4,288,965 issued Sept. 15, 1981 and sold under the trademark ULTIMA by Hayssen Manufacturing Company of Sheboygan, Wisconsin, a subsidiary of the assignee of this invention and application, this patent being incorporated herein by reference. This VFFS machine 1 is operable in cycles in each of which a bag length increment of a web W of a suitable plastic sheet material, e.g., polyethylene film, is pulled from a supply roll R by measuring and feeding rolls indicated at 19 and 21 and fed over a forming shoulder 3 for forming it into bag tubing T around a downwardly extending tubular mandrel 13. The longitudinal margins of the web are brought together by the forming shoulder and sealed by sealing means such as indicated at 15 extending vertically at the front of the mandrel, forming what is referred to as the "back seam" for the tubing and the packages (bags) formed from the tubing. The bag length increment of web fed forward by the measuring and feeding rolls in each cycle, the feed being intermittent and the web dwelling for an interval between successive feeds, is taken up and pulled over the forming shoulder by means of pull belts indicated at 41 which function intermittently to pull the tubing T downward and feed it off the lower end of the mandrel. Product, e.g., flour, to be packaged is delivered from the mandrel into the lower end of the tubing in special manner according to this invention, as will be subsequently described. Sealing means comprising a pair of sealing members 17 is operable in a fixed horizontal plane below the lower end of the tubing to form bags each with a measured quantity of product therein. The sealing means operates transversely to seal the tubing at a level below the lower end of the mandrel during each dwell of the tubing to form a top seal S2 for a bag B being completed and a bottom seal S1 for the next bag (see FIG. 13). Associated with the sealing means is a knife 71 for severing the tubing between each top and bottom seal during each dwell. This knife corresponds to the knife 71 operated by air cylinder 209 shown in the Cherney U.S. Pat. No. 4,546,596 issued Oct. 15, 1985 to Hayssen Manufacturing Company, this patent also being incorporated herein by reference. Stagers for pinching the tubing closed above the sealing members to prevent product from dropping down in the tubing on a seal made by the sealing members before the seal has adequately set are indicated at 10.

In each cycle of operation, with the stagers 10 and sealing members 17 open, a bag length increment of the tubing T, sealed as indicated by the reference character S1 at its lower end as a result of the previous cycle, is fed down off the lower end of mandrel 13. The measured quantity of product for the bag which is being formed in the cycle is delivered downwardly from the mandrel in the special manner of this invention into the lower end of the tubing, as will be described. The sealing members 17 are closed on the tubing above the level of the product to form a top seal S2 for the bag being completed and a bottom seal S1 for the next bag to be formed. The knife indicated at 71 herein (and at 71 in the aforesaid Cherney U.S. Pat. No. 4,546,596) incorporated in the sealing means operates to sever the tubing transversely between the bag top seal and the bag bottom seal made by the sealing bars. The stagers 10 are closed when the sealing members are closed to keep product from dropping down onto the seals being made. First the sealing members and then the stagers are opened as the cycle concludes for release of the completed bag and for the start of the next cycle. Each bag, as completed on the closure of the sealing members to form the top seal therefor and the cutting of the tubing T between that seal and the bottom of the next bag and upon opening of the sealing members and stagers to release it, comes to rest on a support 12 from which it is pushed off by an ejector 14. As above-noted, the vertical form-fill-seal machine 1 is preferably one such as shown in the James U.S. Pat. No. 4,288,965, which is incorporated herein by reference, and to which reference may be made for further detail. Reference may also be made to the aforesaid Cherney U.S. Pat. No. 4,546,596, also incorporated herein by reference, for particulars of the means for operating the sealing members 17 and the knife 71. Reference may be made also to the Kovacs U.S. Pat. No. 4,532,753 issued Aug. 6, 1985 to Hayssen Manufacturing Company for particulars of the means for operating the sealing members, this patent also being incorporated herein by reference.

Figure 1:
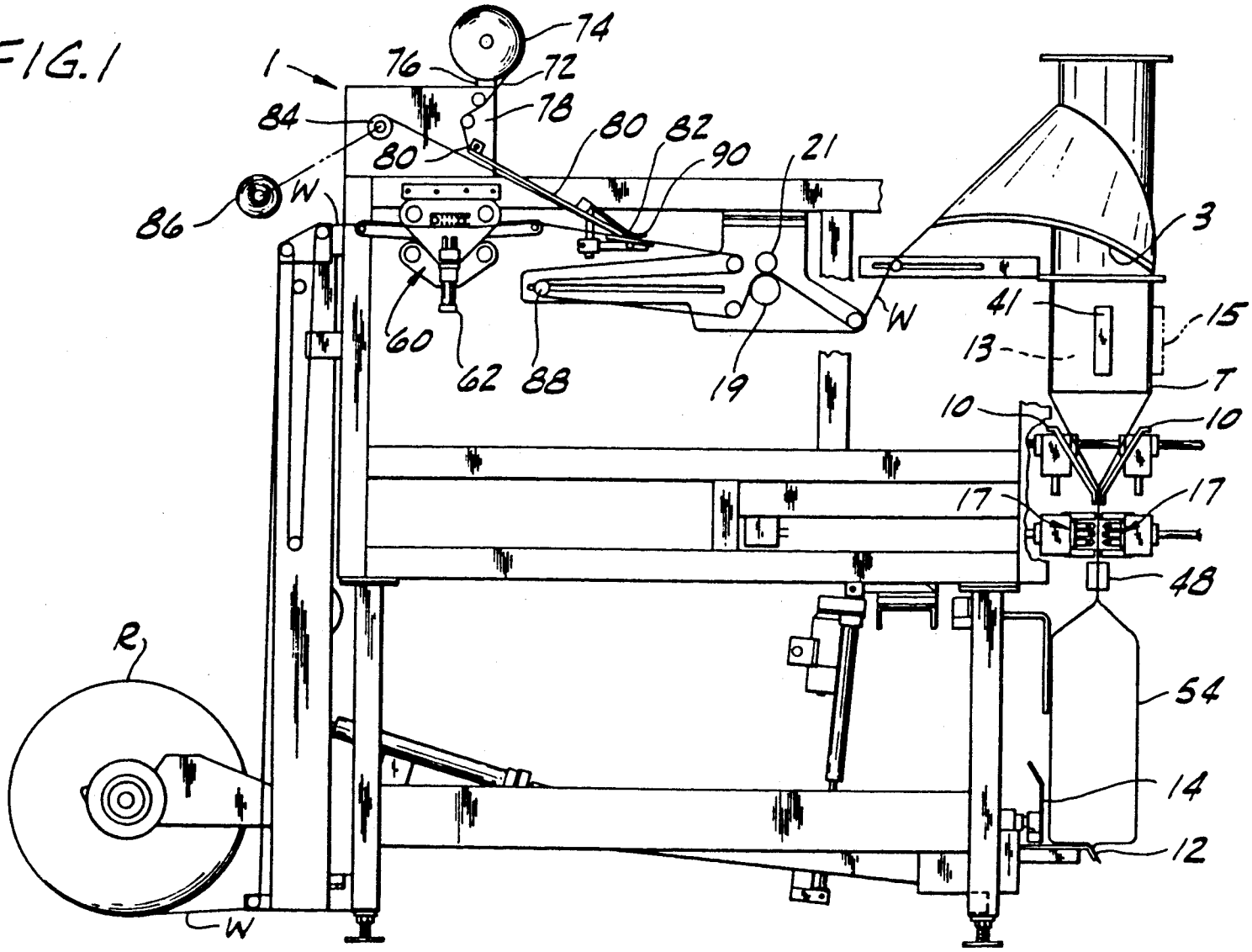
FIG. 1 is a semi-diagrammatic view in side elevation of one side of apparatus of this invention for carrying out the method of this invention, parts being broken away and parts omitted.
Figure 2:
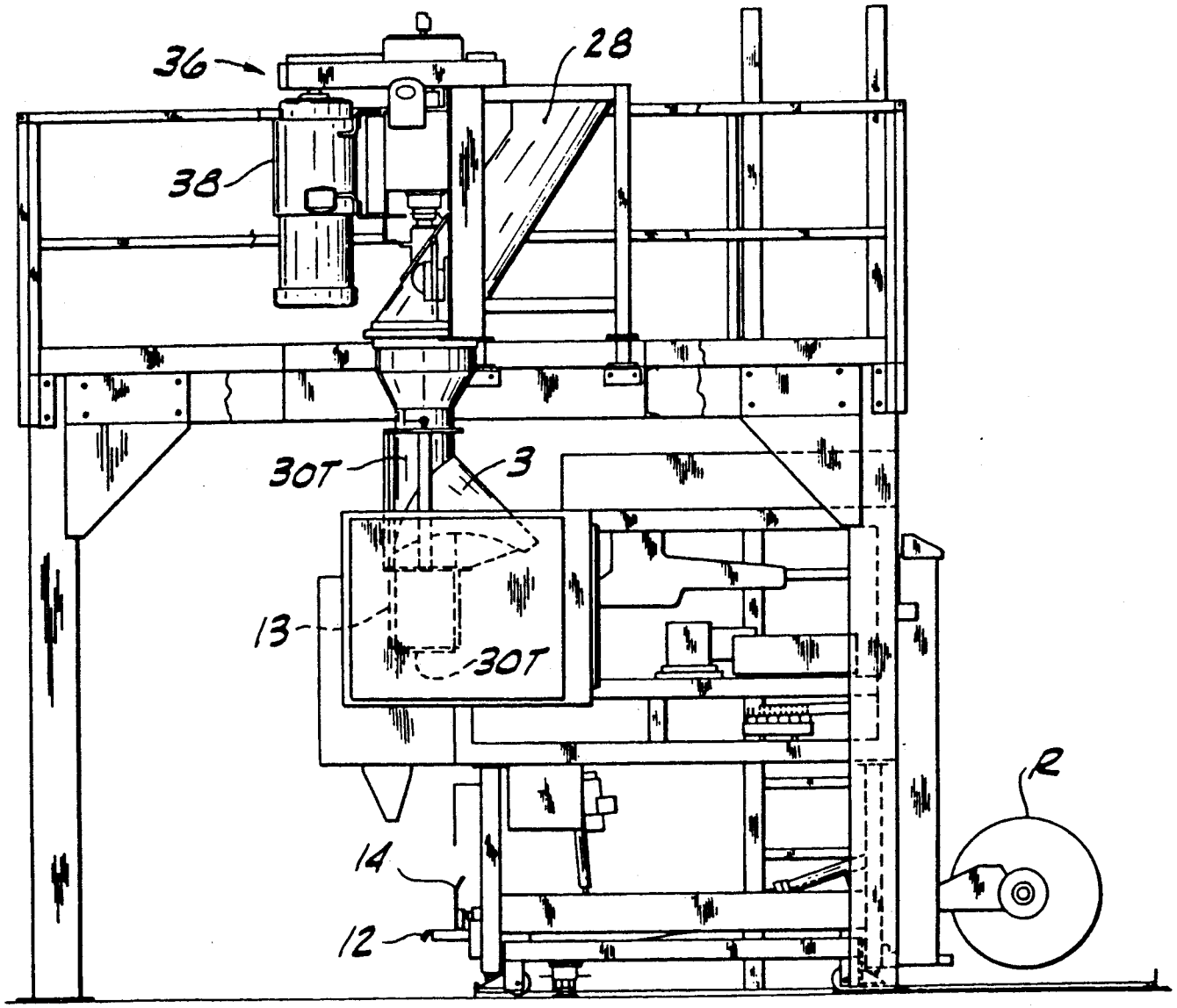
FIG. 2 is a semi-diagrammatic view on a smaller scale than FIG. 1 of the other side of the apparatus, parts being omitted.
Figure 3:
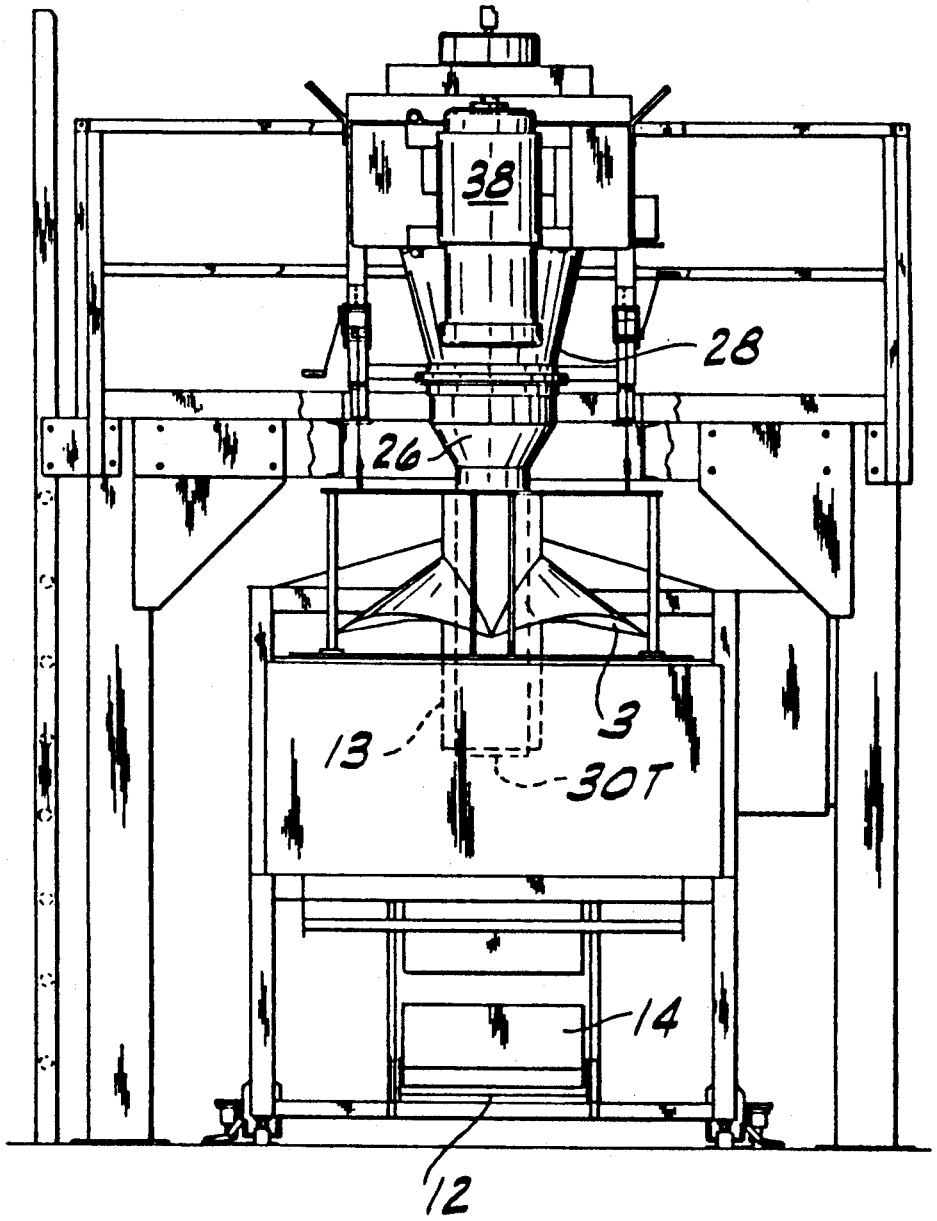
FIG. 3 is a semi-diagrammatic view in front elevation of the apparatus (as viewed from the left of FIG. 2), parts being omitted.
Figure 4:
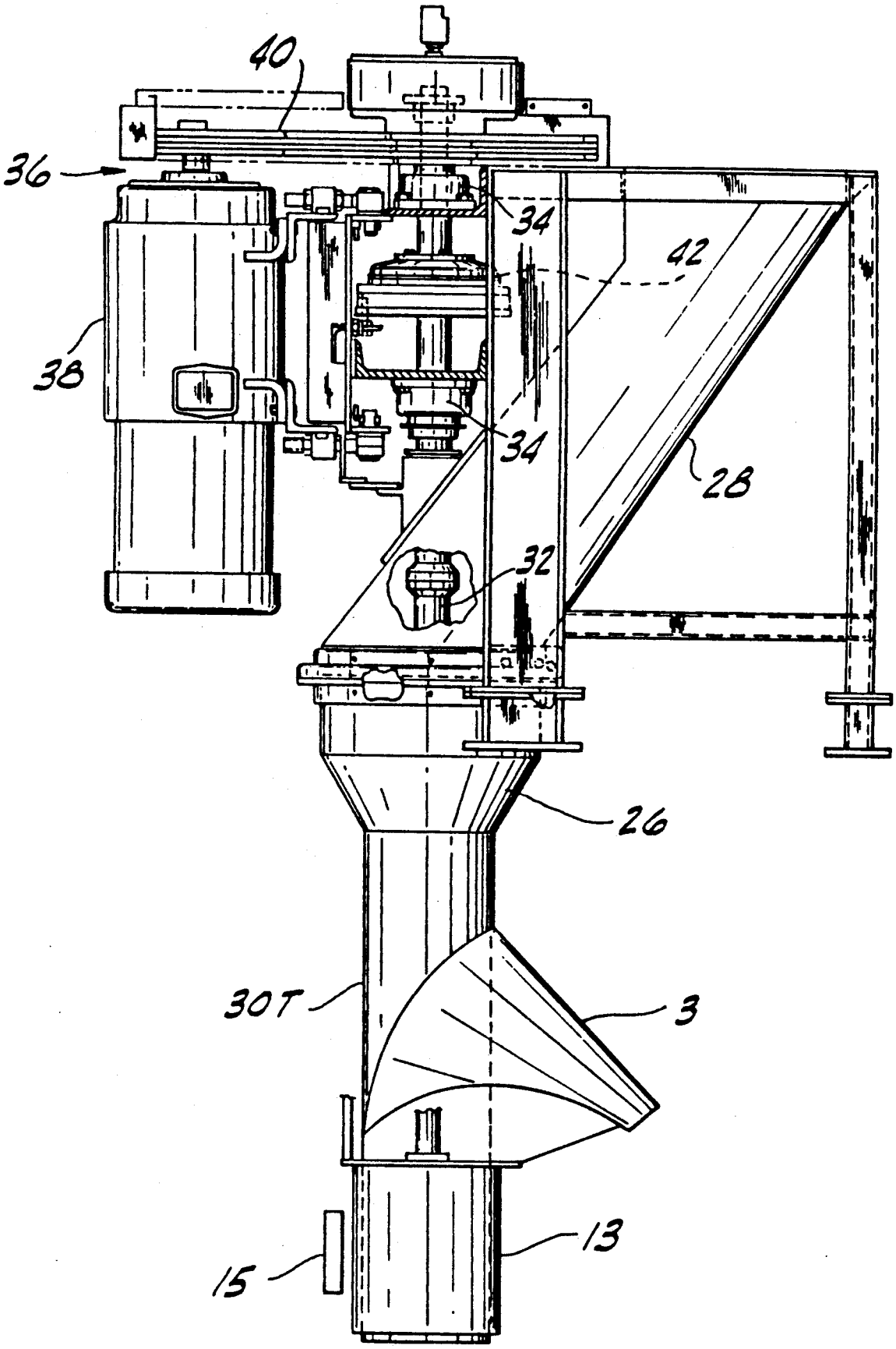
FIG. 4 is an enlarged fragment of FIG. 2 with certain parts in section.
Figure 6:
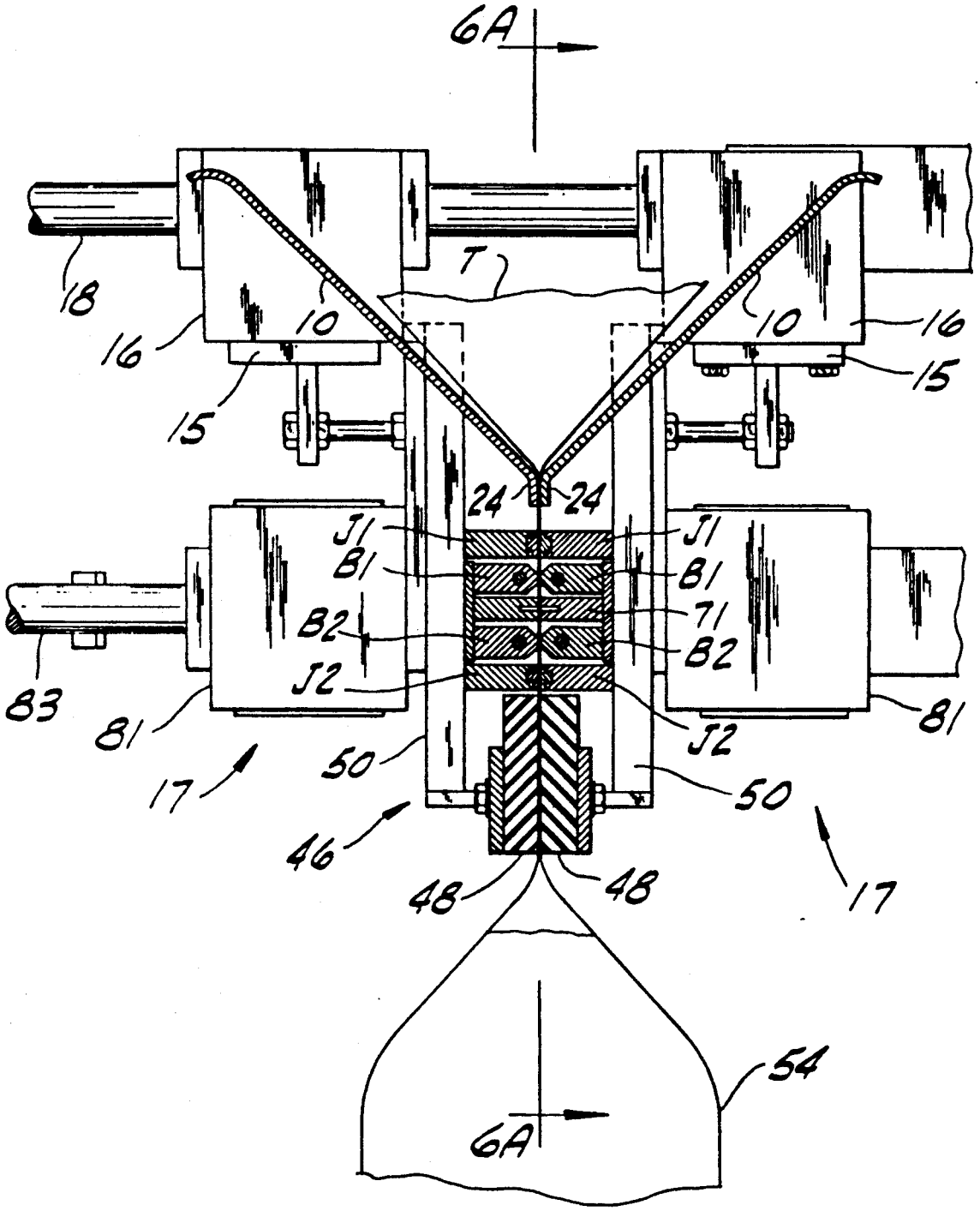
FIG. 6 is a view of part of FIG. 1 in section on a larger scale than FIG. 1 showing certain sealing, staging and deflating means, of the apparatus.
Figure 6A:
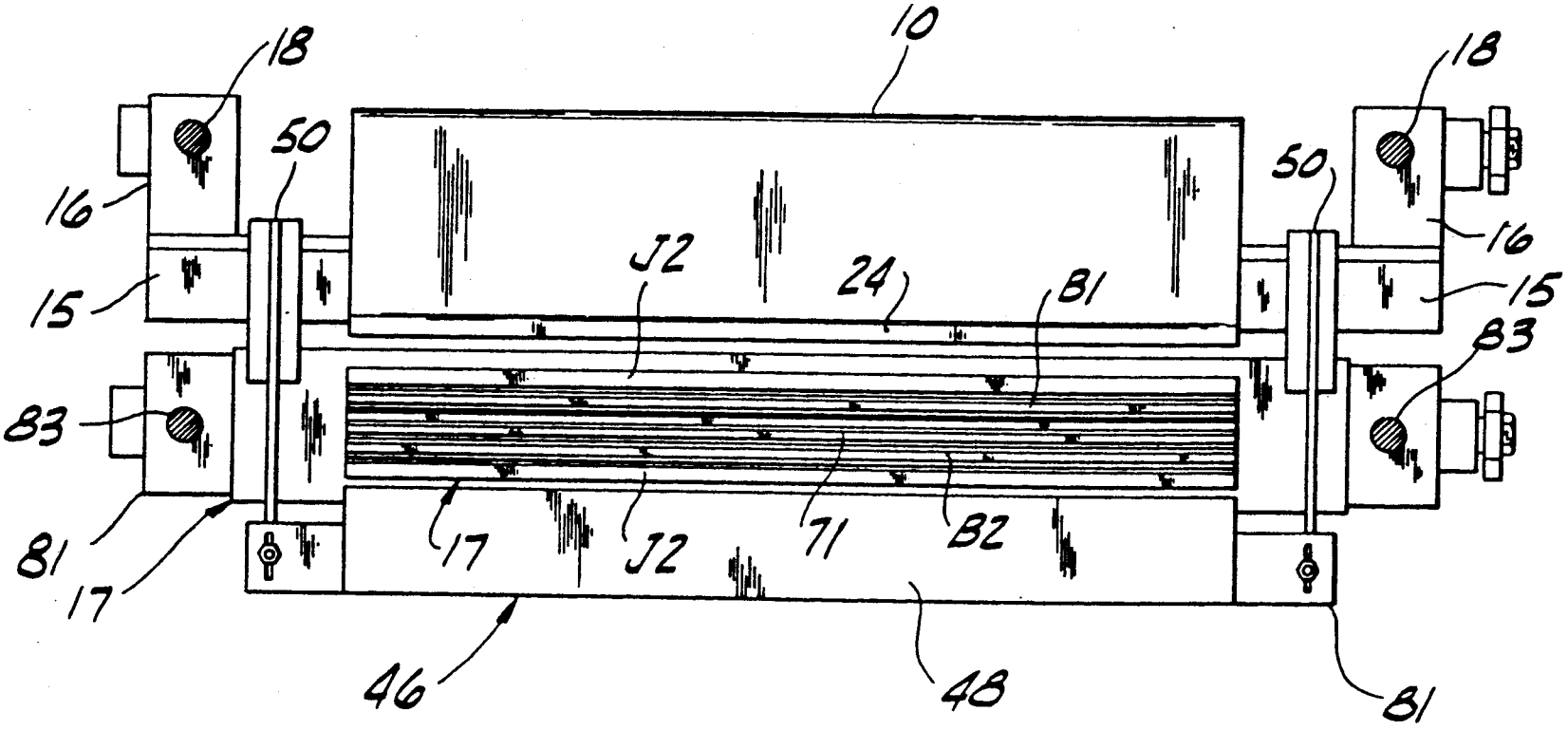
FIG. 6A is a vertical section on line 6A—6A of FIG. 6.
Figure 7:
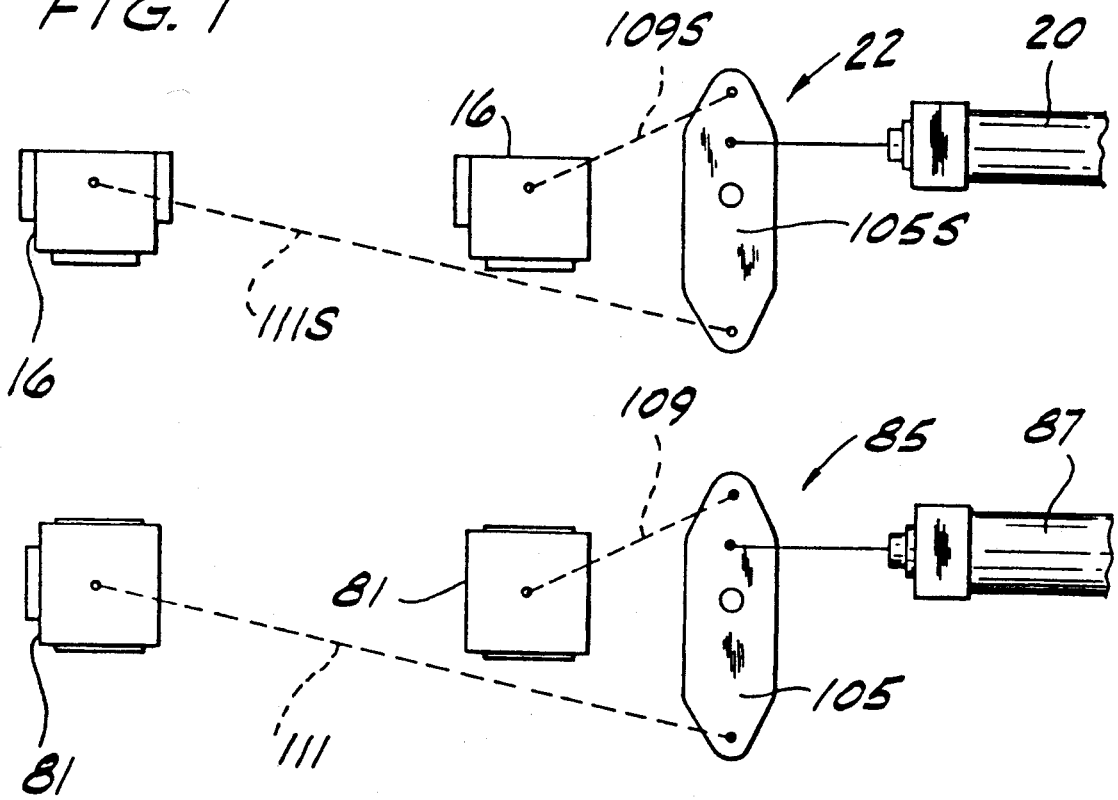
FIG. 7 is a diagrammatic view illustrating means for operating the sealing and staging means shown in FIG. 6.

As best illustrated in FIG. 6, 6A and 7, the sealing members are carried by slides 81 slidable on guide rods 83 operated by means indicated at 85 in FIG. 7 including an air cylinder 87 for oscillating cranks such as indicated at 105 linked to the slides 81 by links 109 and 111 as in the Cherney U.S. patent. Each sealing member 17 comprises an upper clamping jaw J1 and a lower clamping jaw J2, between which are upper and lower sealing bars B1 and B2 operable to heat seal the tubing to form the seals S1 and S2 when the jaws J1 and J2 clamp the tubing. The knife 71 is operable between the sealing bars B1 and B2. The stagers 10 are carried by crossbars 15 extending between slides 16 slidable on guide rods 18 and operated by an air cylinder 20 via linkage such as indicated at 22 including cranks such as indicated at 105S and links 109S and 111S similarly to the operation of the sealing members 17, the stagers being reciprocable in a horizontal plane just below the lower end of the mandrel (instead of being swingable like the stagers 75 in the Kovacs U.S. Pat. No. 4,532,753). The stagers 10 comprise inclined plates which converge toward one another in downward direction, their lower edges 24 being adapted, on closure, to pinch the tubing (as shown in FIGS. 1 and 6).

Figure 5:
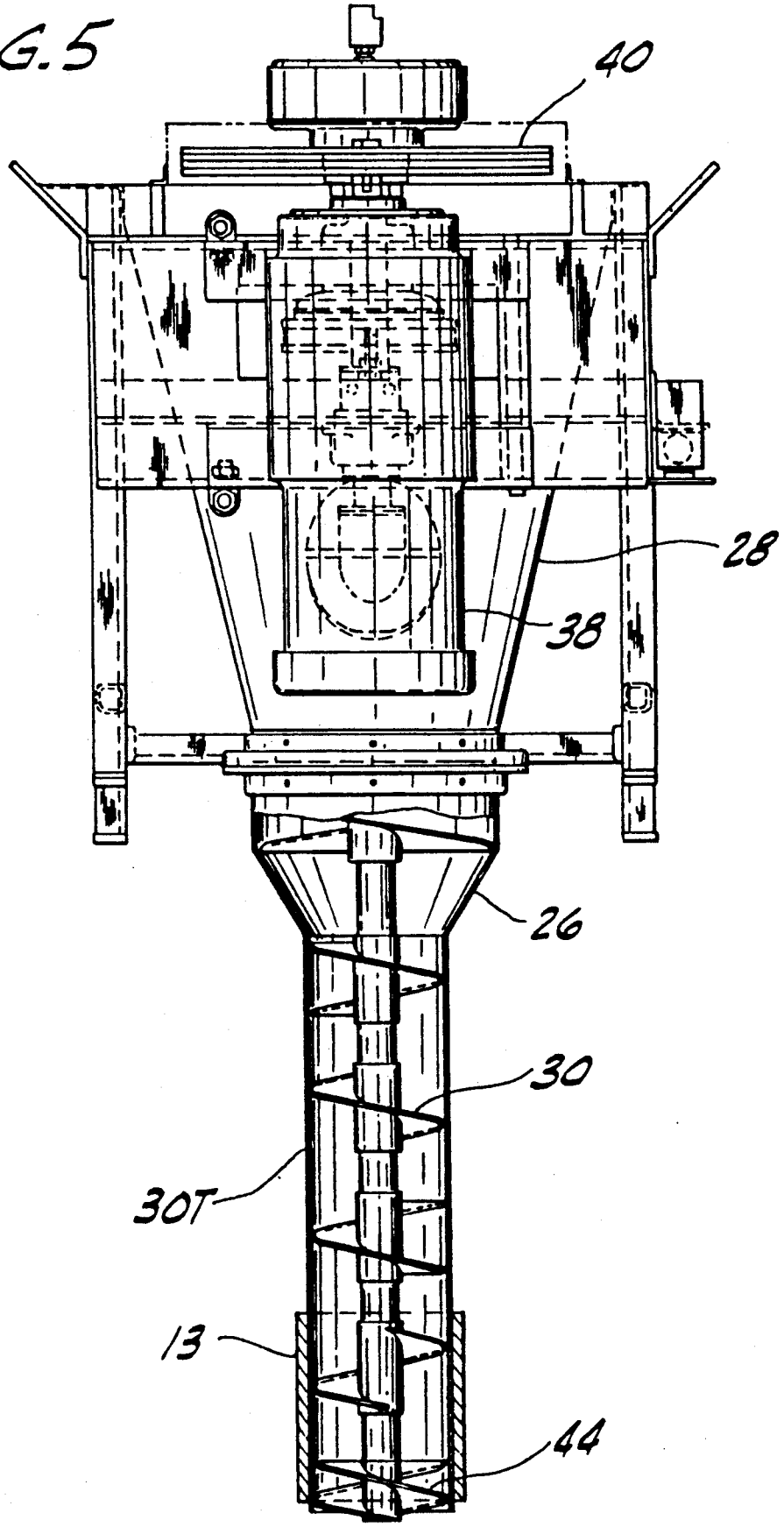
FIG. 5 is a view in front elevation of FIG. 4 broken away to show an auger of the apparatus.

Means for feeding product into the portion of the tubing, sealed at the bottom by the seal S1, and being fed off the lower end of the mandrel, is shown to comprise an auger 30 (see FIG. 5) in a cylindrical auger tube 30T which extends down through the mandrel generally to the lower end of the mandrel operable to auger product at a measured rate out of the lower end of the auger tube (and the mandrel) into the lower end portion of the tubing T. The auger tube 30T has a funnel formation 26 at its upper end for funneling product thereinto from a hopper 28. As herein illustrated, the auger tube, with the auger therein, extends slightly below the lower end of the mandrel 13, which may be generally of oval cross-section. As appears in FIG. 4 the hopper 28 is inclined and the auger shaft 32 extends up through the hopper, being journalled in bearings such as indicated at 34 above the hopper. The shaft 32 is adapted intermittently to be driven at a generally constant predetermined speed for augering out the product at a predetermined rate, i.e., to deliver a predetermined volume of product in a unit interval of time, by a motorized drive indicated generally at 36 including a motor 38 operable continuously at a selected predetermined speed driving via a belt and pulley drive 40 the input of an electrically operated clutch 42, the shaft 32 being direct-driven off the output of the clutch. As shown in FIG. 5, the auger has a relatively close-pitch flight 44 at its lower end.

Means generally indicated at 46 (FIG. 6) is provided for deflating each bag as it is formed, "deflating" particularly meaning squeezing the package just below the sealing members 17 and above the level of product in the bag to flatten the bag above the product and expel air upwardly therefrom just before the sealing members 17 close for forming the top seal S2 for the bag being completed (and the bottom seal S1 for the next bag to be formed). This deflating means comprises a pair of padded deflator bars 48 which extend transversely of the machine just below the sealing members 17 carried by brackets 50 which extend down from the crossbars 15 which carry the stagers 10, these brackets 50 being located outwardly of the ends of the sealing members 17 so that there is no interference between the deflator bars and the sealing members. The deflator bars are reciprocable by and with the stagers in a horizontal plane just below the level of the sealing members 17 between an open position (for the downward feed of the tubing T) and the position closed on the tubing in which they are illustrated in FIGS. 1 and 6.

Figure 11:
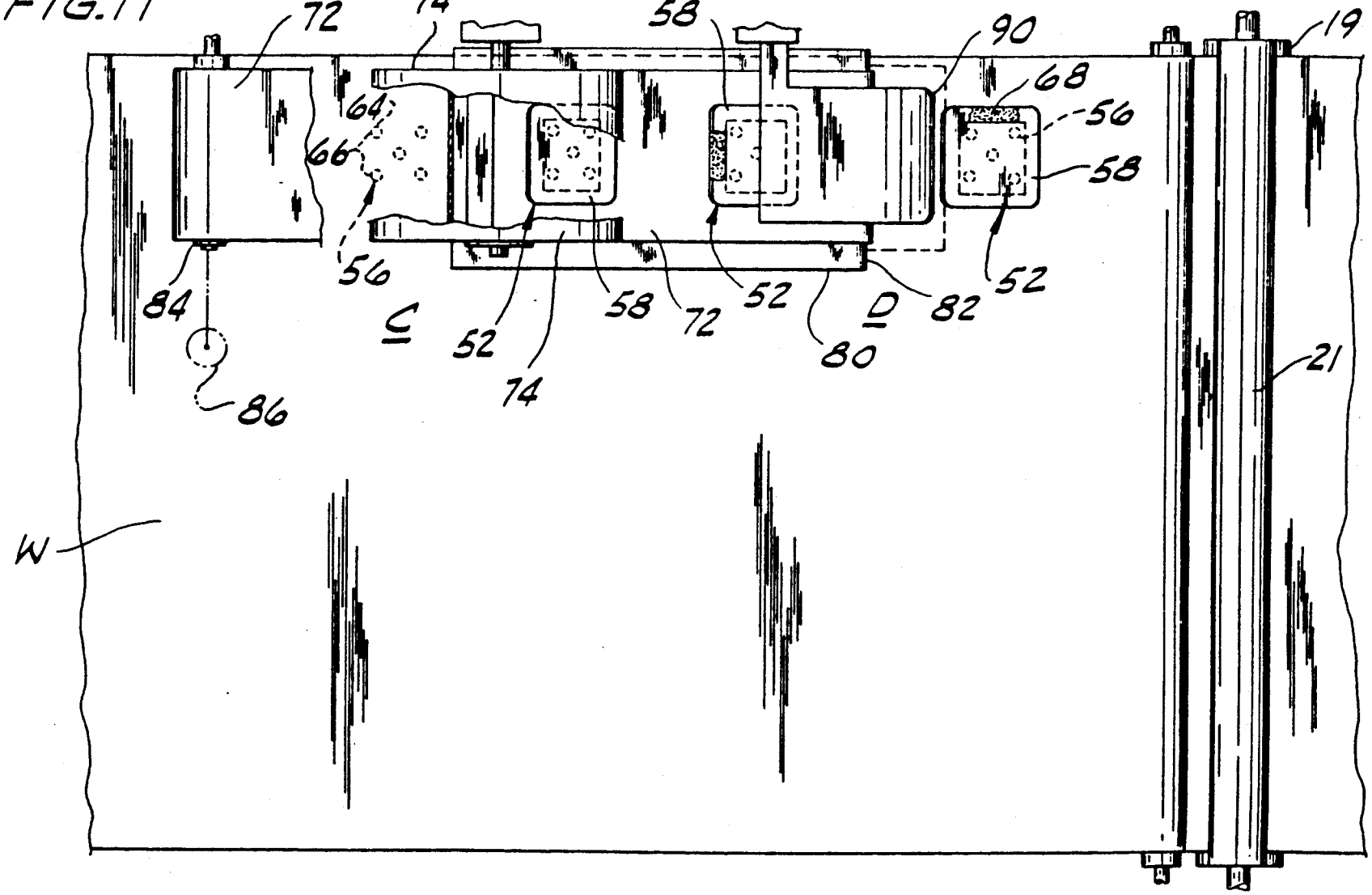
FIG. 11 is a view in plan with parts broken away and shown in section of means of the apparatus for providing each bag which is formed, filled and sealed thereby with air vent means.

Along its path of travel from the supply roll R to the forming shoulder 3, the web W is provided at bag length intervals with air vents generally designated 52 (see FIG. 11), one for each bag 54 (FIG. 13) that is ultimately formed. Each vent comprises a set of vent holes 56 covered by a patch 58 of filter material, such as a piece of spun polypropylene, pervious to air but substantially impervious to the pulverulent product and insects. The vent holes 56 are punched in the web at a station C along the path of travel of the web from the supply roll to the forming shoulder by means of a set of punches indicated at 60 in FIG. 1 operated by an air cylinder 62, these punches being adapted to punch out tab-like portions 64 of the web leaving them attached to the web by bridge portions as indicated at 66 to avoid the necessity for disposing of punched-out material as waste. The patches 58 are supplied for application to the web over the sets of vent holes 56 at bag length intervals adhered by means of a suitable pressure-sensitive adhesive 68 all around their margin to a backing tape 72, the patches being spaced at intervals along the length of the tape, which is wound into a roll 74 mounted as indicated at 76 generally above the path of the web. The tape 72, carrying the patches 58, is guided by guide means such as indicated at 78 for travel from the supply roll 74 over the top surface of a separator plate 80 which is inclined downward toward the web with its leading or forward edge 82 closely adjacent the upper surface of the web (which will become the inner surface of the bags) at a patch transfer station D downstream from the punch station 58. At 84 (see FIG. 1) is indicated a rewind for the tape having a suitable drive such as indicated at 86 for pulling the tape around the forward edge of the separator plate and back under the separator plate. The rewind 84 is operated as the web is fed forward to feed the tape around the edge 82 at a speed corresponding to that of the web. As the web W is fed forward and the tape is fed around the edge 82 and back, a patch 58 is fed straight forward off the tape and becomes adhered by the adhesive 68 to the upper surface of web W in position covering a set of vent holes 56 in the web, the adhesive surrounding the set of holes, the punched-out portions 64 of the web being left free to open out away from the patch. As will be readily understood, the web and tape are phased for registration of the patches with the sets of vent holes. The patches are pressed down on the web just downstream from the edge of the separator plate by means such as indicated at 90. The web with the patches adhered thereon proceeds to the forming shoulder 3 which forms it into the tubing T around the mandrel 13 with the patches on the inside of the tubing spaced at bag length intervals along the length of the tubing so that there is a vent (a set of holes 56 with a filter patch 58) for each bag that is formed. A registration compensation roller is indicated at 88. The registration is preferably such that, as to each bag 54, the vent is located adjacent the back seam of the bag and toward one end of the bag (see FIG. 13).

Figure 8:
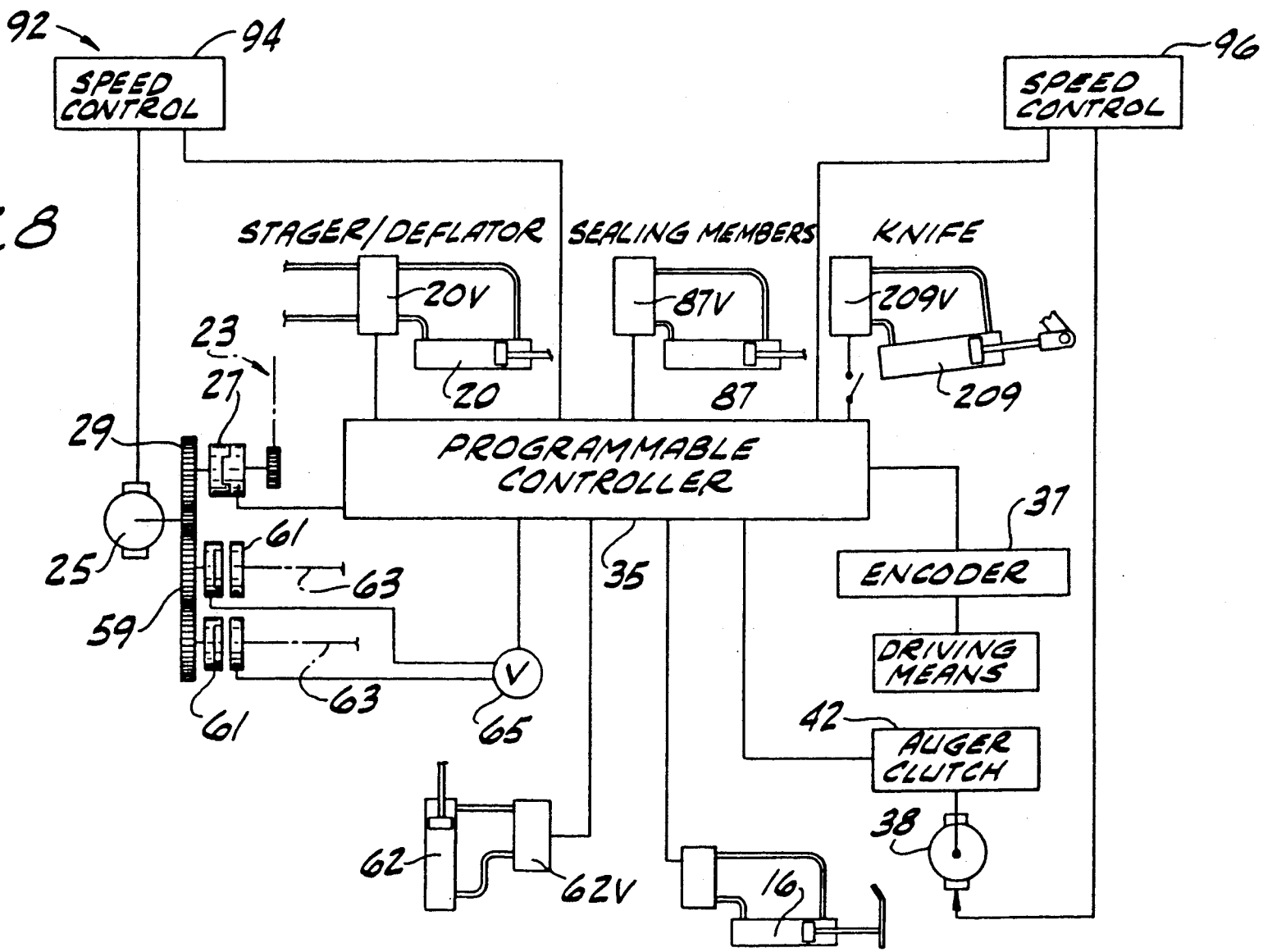
FIG. 8 is a diagram showing control means of the apparatus.

As in the ULTIMA machine described in the aforesaid James U.S. Pat. No. 4,288,965, the measuring rolls 19, 21 are intermittently driven by means indicated generally at 23 through a predetermined interval corresponding to the desired length for the packages (bags) to be formed to feed the web forward one such increment. As shown in FIG. 8, the driving means 23 comprises a continuously operating electric motor/speed reducer unit 25 driving the input of an electric clutch/-brake unit 27 via gearing indicated at 29, the output of the clutch/brake unit being connected to the lower roll 19 as indicated at 31 in said James patent. The rolls 19 and 21 are geared together as indicated at 33 in said James patent. The clutch of unit 27 is adapted intermittently to be engaged and the brake of unit 27 disengaged for driving the rolls 19 and 21 to feed forward the requisite package length increment of web W on each feed cycle by a suitable programmable controller 35 which is under the control of an encoder 37, the clutch being disengaged and the brake engaged to terminate the feed cycle and remaining so for the dwell of the web W and tubing T, the clutch then being engaged and the brake disengaged for the next feed cycle.

The web W travels from the measuring and feeding rolls 19 and 21 under a guide roll 38 (see FIG. 1) and thence up to and around forming shoulder 3. The increment of the web W fed forward by the measuring and feeding rolls 19 and 21 is taken up and pulled over the forming shoulder 3 under tension by the pull belts 41, which may be vacuum belts as described in the aforesaid James U.S. patent adapted to be driven as shown in said patent by a gear drive 59 from the electric motor/-speed reducer unit 25 to the input of each of a pair of air-operated slip clutches each designated 61 with individual drive trains as indicated at 63 from the outputs of the slip clutches to the upper pulleys for the two belts 41. Again, the slip clutches are under control of an air valve 65 which is in turn controlled by the programmable controller 35 for the apparatus. The latter functions to actuate (engage) the slip clutches 61 to start driving the belts either at the same time or somewhat before the electric clutch/brake unit 27 is actuated, and to maintain the slip clutches engaged for driving the belts until the electric clutch/brake unit 27 is deactuated or somewhat thereafter, the slip clutches then being deactuated to stop the belts. While engaged, the slip clutches permit slip in the drives from the unit 25 to the belts.

In the operation of the apparatus, the motor/speed reducer unit 25 is operated continuously. The clutch/-brake unit 27 is actuated (i.e., its clutch is engaged, its brake disengaged) in timed relation to a function of the apparatus such as a filling function, the encoder 37 being operable to signal the programmable controller 35 to actuate the unit 27 to start driving rolls 19 and 21 to unwind the web W from the supply roll R and feed it forward at the appropriate time. The unit 27 remains actuated for an interval such as to cause rotation of the rolls 19 and 21 to feed forward a package length increment of the web, and is then deactuated. The interval may be determined and controlled via the programmable controller 35 or by means of an optical scanning system operating in conjunction with registration marks at package length intervals on the web in the case of preprinted web, or by means measuring the rotation of the rolls 19 and 21 in the case of unprinted web, or in other suitable manner well known in the art.

The programmable controller 35 operates to actuate the valve 65 for engaging the slip clutches 61 to start driving the belts 41 either at the same time or somewhat before the rolls 19 and 21 start feeding the web W forward toward the forming shoulder 3. Thus, when the rolls 19 and 21 operate to feed the web forward, the belts are in operation and act to draw down the tubing T formed as the web passes over the forming shoulder 3. The drive for the belts is such that they tend to travel at a rate greater than the rate at which rolls 19 and 21 feed the web forward. For example, they may tend to travel at a rate about 10% greater than the rate at which rolls 19 and 21 feed the web forward (that is, the belts if wholly free of any restraint would travel a distance 10% greater than the amount of web released (i.e., fed forward) by rolls 19 and 21. However, the tubing T cannot advance any faster than the rate at which rolls 19 and 21 feed the web forward without stretching (the web being caught in the nip of rolls 19 and 121) and the pull exerted by the belts on the tubing is relatively light and too low to cause any substantial stretching. Hence, the belts travel generally at a greater rate than the web and, in tending to travel faster than the web, exert a downward pull on the tubing T to tension it and thereby pull the material over the forming shoulder 3 under tension to maintain the web taut. The operation of the belts at a greater rate than the speed of the web feed is governed and controlled by slippage in the slip clutches 61, and by some slippage of the belts past the packaging material.

At the start of the downward feed of the tubing T, the sealing members 17 are open, and remain open throughout the downward feed of the tubing off the lower end of the mandrel 13. When the rolls 19 and 21 have measured out and fed forward one package length of web W, and the belts 41 have drawn the tubing T down one package length on the mandrel and fed one package length of the tubing T off the lower end of the mandrel, the clutch/brake unit 27 is deactuated to stop the rolls 19 and 21 and thereby stop the forward feed of the web, for the dwell of the web and the tubing for the sealing operation. The slip clutches 61 are deactuated either at the same time as the rolls 19 and 21 stop, or slightly thereafter. When deactuated, the slip clutches may be wholly disengaged so as to stop drives 63 to the belts 41, or they may remain lightly engaged to exert a light drive via 63 on the belts so that the belts exert a light draw-down force on the tubing to maintain tension in the tubing.

With the tubing T stopped, and with product in the tubing above the transverse seal S1 at the lower end of the tubing (this seal being one package length below the sealing members 17 and constituting the bottom seal for the package to be completed) the sealing members are closed on the tubing to form the top seal S2 for the package P being completed and the bottom seal S1 for the next package to be formed. The sealing members then open, and rolls 19 and 21 and belts 41 are operated through the next feed cycle.

Figures 9, 10A, 10B, 10C, 10D, 10E:
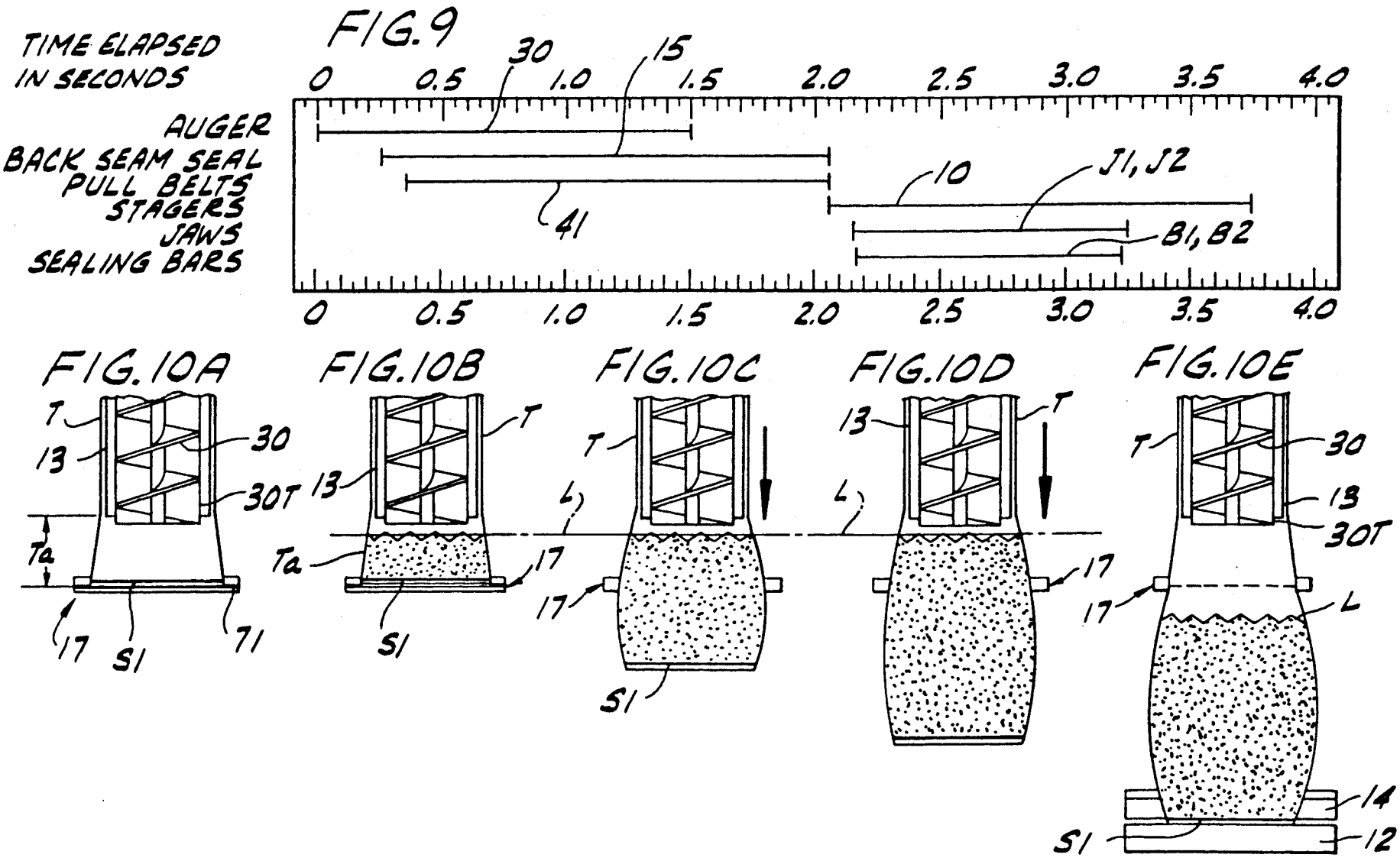
FIG. 9 is a chart showing the timing of the apparatus.
FIG. 10A–E are views showing successive stages in the formation and filling of a bag.

The air cylinder 87 for operating the sealing members 17, air cylinder 209 for operating the knife 71, the air cylinder 20 for operating the stagers, and the air cylinder 62 for operating the punches 60 under control of air valves 87V, 209V, 20V and 62V, respectively, are controlled as indicated in FIG. 8 by the programmable controller 35. The auger clutch 42 is also under control of the programmable controller as indicated in FIG. 8. The programmable controller is programmed for timing the operations of the various components of the apparatus to occur in a sequence per cycle such as indicated in the FIG. 9 timing chart for certain of the components. At the start of a cycle as shown therein, the sealing members 17, stagers 10 and deflators 48 are open, and the clutches 27, 61 and 42 are deactivated so that the measuring rolls 19 and 21, pull belts 41 and auger 30 are off. As shown in FIG. 10A, there is a relatively short length Ta of tubing T extending down from the lower end of the mandrel 13 to the level of the knife 71, at which level the tubing has been severed on the previous cycle to separate the bag which was filled on the previous cycle from the lower end of the tubing. This lower end portion Ta of the tubing is sealed at its lower end by seal S1, ready to receive product fed out of the lower end of the mandrel by the auger 30. Under control of the programmable controller 35, the auger is started at the start of the cycle (at 0 seconds as shown in the FIG. 9 timing chart) and continued in operation for the period of time needed for the number of revolutions of the auger needed to deliver the desired volume of product (the "charge") for a bag. As illustrated in FIG. 9, this period of time is 1.5 seconds. At 0.25 seconds into the cycle, the means 15 for sealing together the longitudinal margins of the web for forming the back seam is activated and maintained activated until 2.05 seconds into the cycle. The tubing T dwells for a predetermined interval following the start of the cycle, e.g., until 0.35 seconds into the cycle, allowing for feed of product into the lower end portion Ta of the tubing until the level of product in the tubing is brought up to level L relatively closely adjacent and just below the lower end of the mandrel as illustrated in FIG. 10B. At this point, e.g. 0.35 seconds into the cycle, with the measuring rolls 19 and 21 in operation, the pull belts 41 are activated to feed the tubing T downwardly off the lower end of the mandrel 13 and continued in operation until they have fed a bag length increment of the tubing downwardly between the open sealing members 17 for the formation of a bag of that length. The starting and stopping of the pull belts 41 is under control of the programmable controller 35, the latter acting to activate and deactivate the clutches 61 (and 27) at the appropriate times. The downward feed of the tubing is at a predetermined rate, as determined by the speed of the motor 25. As illustrated in FIG. 9, the pull belts stop at 2.05 seconds into the cycle, at the same time that the back seam sealing means is inactivated. It will be understood by reference to the aforesaid James U.S. Pat. No. 4,288,965 that the measuring rolls 19 and 21 are started generally at the same time as the pull belts 41, and the 0.35 to 2.05 line on the FIG. 9 timing chart is illustrative of the operation of the measuring rolls in conjunction with the pull belts to feed the bag length of tubing downwardly off the lower end of the mandrel, it being understood that the belts may be started somewhat before the measuring rolls are started and stopped shortly after the measuring rolls stop.

It will be observed that the rate of feed of the tubing T downwardly off the lower end of the mandrel is determined by the speed of the motor 25 for driving the rolls 19 and 21 and the pull belts 41, and that, for a given rate of feed, a given volume of tubing is created in a unit interval of time by the downward feed of the tubing off the lower end of the mandrel. It will also be observed that the rate of feed of the product (e.g., flour) downwardly out of the lower end of the mandrel 13 is determined by the speed of the auger motor 38. In accordance with this invention, the tubing T is fed downwardly at a predetermined rate (which may be varied) and the product is fed downwardly out of the lower end of the mandrel into the lower end of the tubing at a predetermined rate (which may be varied); with these two rates being so related as to effect substantial filling of the volume of the lower end portion of the tubing created by the downward feed of the tubing. That is, as a certain volume of the tubing is created at its lower end as it is fed downwardly off the lower end of the mandrel 13, a corresponding volume of product is delivered to fill that volume. For example, if the mandrel diameter and rate of feed of the tubing are such that in each 0.1 second of downward feed of the tubing, 100 cubic inches of volume is created in the lower end of the tubing, then approximately 100 cubic inches of product is fed downwardly out of the lower end of the mandrel into the tubing in each 0.1 second interval. The product feed is continued until the desired total volume and level of fill relative to the final package (bag) are achieved. With the product feed equaling the volume of tubing created in each unit interval of time, filling is effected without any substantial free fall of the product which, particularly in the case of a product such as flour, would cause emission of dust, leading to problems such as impeding sealing and too-frequent shut-down for cleaning and maintenance.

For equating the rate of creation of volume of the tubing and the rate of product feed, means such as generally indicated at 92 in FIG. 8 is provided for controlling the speeds of motors 25 and 32 and the ratio of their speeds. As illustrated, this means comprises a speed control device 94 for the motor 25, and a speed control device 96 for the auger motor 38, these speed controls being controlled by the programmable controller for setting the speed of motor 25 for the requisite tubing feed rate and for setting the speed of motor 38 in accordance with the requisite ratio of the speeds of motors 25 and 38.

As noted above, FIG. 10B shows how the lower end portion Ta of the tubing is filled with product up to the level L just below the lower end of the mandrel 13 during the initial phase of operation, following the start of the auger 30 and just before the start of the pull belts 41 to feed the tubing down. FIG. 10C shows the tubing at an intermediate stage of its downfeed and an intermediate stage of the product feed, showing how the bottom seal S1 (at the lower end of the tubing) has progressed down below the level of the sealing members 17 a distance corresponding to about one-third the bag length and how the product level has been maintained at L just below the lower end of the mandrel. FIG. 10D shows the tubing in a further intermediate stage of its downfeed and the final stage of the product feed (auger 30 stopped at 1.5 seconds into the cycle, having delivered the total charge of product into the tubing), and showing how the bottom seal S1 has progressed down below the level of the sealing members 17 a distance corresponding to about two-thirds the bag length and how the product level has been maintained as indicated at L just below the lower end of the mandrel. FIG. 10E shows the tubing at the end of its downfeed (pull belts 41 stopped at 2.05 seconds into the cycle) with the lower end of the tubing bearing on the support 12 and with the product level L now below the sealing members 17 (product infeed having stopped at 1.5 seconds into the cycle, downfeed of the tubing continuing past 1.5 seconds to 2.05 seconds).

When the downfeed of the tubing stops (at 2.05 seconds into the cycle), the valve 20V is activated under the control of the programmable controller 35 to close the stagers 10 on the tubing at a level just above the level of the sealing members 17, thereby to insure against product dropping down in the tubing for protection against product interfering with the sealing of the tubing which is about to occur. The deflators 48 are closed on the tubing in unison with the stagers between the level L of product in the tubing and the sealing members 17, acting to squeeze air out of the tubing from above the product, the air being expelled upwardly in the tubing since the tubing has not yet been clamped closed by the sealing members. Shortly after the stagers 10 and deflators 48 close, e.g., at 2.15 seconds into the cycle as shown in FIG. 9, the valve 87V is activated to activate cylinder 87 to close the sealing members and the jaws Jl and J2 thereof on the tubing and very shortly after the jaws close, the sealing bars B1 and B2 of the sealing members are activated to form the top seal S2 for the bag being completed and the bottom seal S1 for the next bag to be produced. The jaws J1 and J2 remain closed until about 3.25 seconds into the cycle, for example, then open; the sealing bars are deactivated slightly before the jaws open. The valve 209V is activated to activate cylinder 209 to cause the knife 71 to cut the tubing between the seals S2 and S1 after the seals have been made but before the jaws open and, finally, on elapse of 3.25 seconds, for example, the stagers 10 and deflators 48 are opened, thus freeing the completed bag for being pushed off the support by the pusher 14 operated by its cylinder 16.

From the above, it will be observed that product (e.g., flour) is fed downwardly by the auger 30 into the portion of the tubing T sealed at the bottom (at S1) being fed off the lower end of the mandrel 13 with the product feed at a predetermined rate so related to the rate of feed of the tubing as substantially to fill the volume of said portion of the tubing created by the downward feed of the tubing, the product feed being continued until the desired volume and level of fill relative to the first package (bag) length are achieved. For each package (bag) being formed, the feed of the product by the auger is started before the feed of the tubing T, and an amount of product is initially fed into the tubing such as to bring the level of product in the tubing up to a level (the level L) relatively closely adjacent and just below the lower end of the mandrel (and the auger tube 30T) (see FIG. 10B). That level of product is substantially maintained as the tubing is fed downwardly and until the amount of product for filling the package (bag) has been delivered (see FIGS. 10C and 10D). The delivery of the product is then terminated (FIG. 10D) and the downward feed of the tubing is continued until the feed of the package (bag) length has been completed and the product level is below the level of the sealing members 17 (see FIG. 10D). Then the tubing is sealed by members 17 to form the top seal S2 for the package (bag) being completed, the bottom seal S1 for the next, and severed between the seals by the knife 71. In another context, the tubing T is fed downwardly off the lower end of the mandrel at a predetermined rate (determined by the speed of motor 25 as established by the speed control 94) such that a predetermined volume of tubing is generated in a unit interval of time, and product is fed downwardly and out of the lower end of the mandrel by the auger 30 into the tubing at a predetermined rate (determined by the speed of the auger motor 38 as established by the speed control 96) so related to the rate of feed of the tubing that a predetermined volume of product substantially equal to said predetermined volume of tubing is fed into the tubing in said unit interval of time. The particular rates specified above are, of course, by way of example only. The bottom-up mode of filling enables efficient operation even with a product such as flour, and accurate filling with ready change or correction for target weight. The production in the course of the VFFS operation of the bags with the air vents is advantageous for packaging flour and other fluent solid products with provision for continuing venting of air from the packages.

FIGS. 14–21 illustrate a modification, for packaging fluent solid products, wherein instead of augering the product into the tubing T, charges of the product are pre-measured as by weight or volume, each measured charge being held within the mandrel adjacent its lower end for delivery on an ensuing downfeed of the tubing T one package length increment, the delivery being generally at a rate determined by the rate at which volume of the tubing is created by the downfeed of the tubing. This modification is essentially the same as the embodiment of FIGS. 1–8, corresponding reference characters indicating corresponding parts, with the difference that the auger of the embodiment of FIGS. 1–8 is replaced by means indicated generally at 100 for holding within the mandrel 13 a measured charge of product to be packaged and for delivering the charge into the tubing T on the next downward feed of the tubing following the dispensing of the measured charge thereinto (i.e., the downward feed of one package length of tubing T). More particularly, this holding and delivering means 100 comprises a tube 102 extending vertically within the mandrel 13 concentrically with respect to the mandrel and extending downwardly out of the lower end of the mandrel to a level indicated at L1 above and closely adjacent the general sealing level L2 (indicated as the horizontal plane in which the knife 71 severs the tubing between each top seal S2 and bottom seal S1), and having means indicated generally at **102*a* for closing its lower end to hold the charge therein, this closing means being opened for a downward feed of the tubing T and delivery of the charge into the newly created volume as the tubing is advanced. In accordance with this invention, the closing means comprises a resilient flexible tubular extension 102A (made of a suitable rubber, for example) of the tube 102 at its lower end which is pinched closed by the stagers 10 acting upon the flexible tubular extension through the tubing T when the stagers 10** are closed on the tubing.

Figure 14:
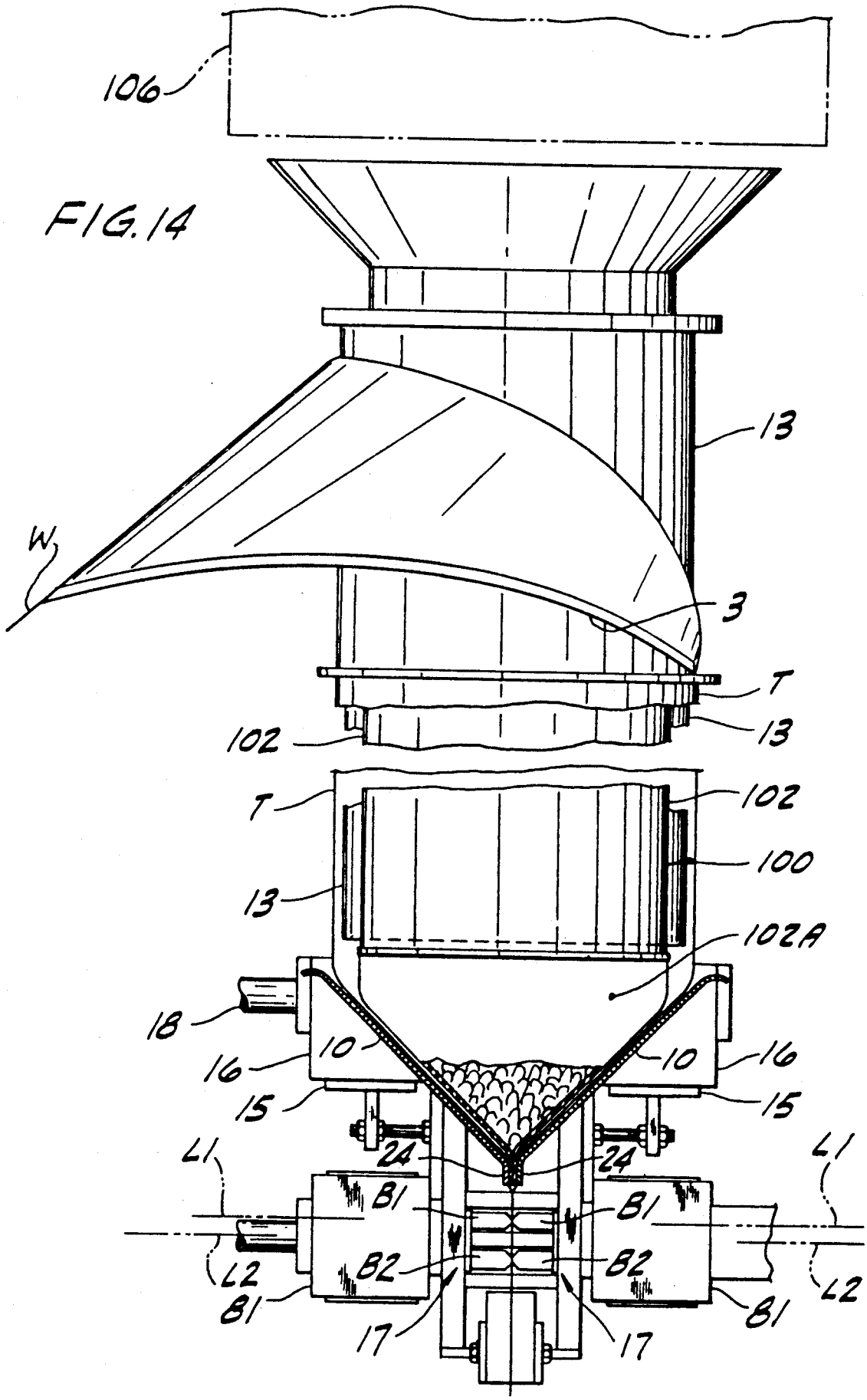
FIG. 14 is a view similar to FIG. 6 showing a modification of the apparatus of FIGS. 1–13 wherein the auger is replaced by means which holds within the mandrel a measured charge of a fluent solid product to be packaged.
Figures 16, 17, 18, 19, 20, 21:
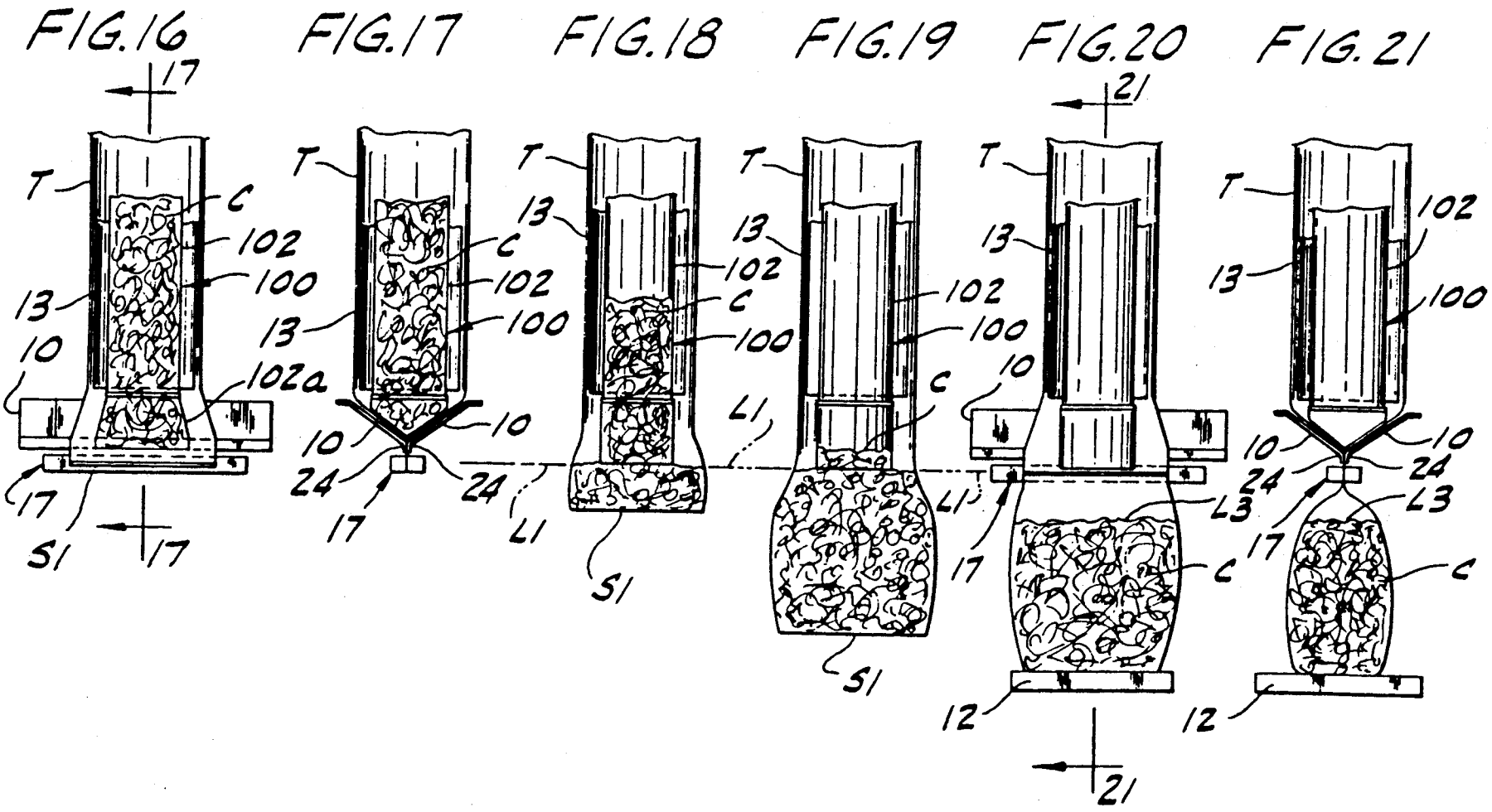
FIG. 16 is a view similar to FIG. 10A showing the FIG. 14 embodiment.
FIG. 17 is a view generally on line 17—17 of FIG. 16.
FIGS. 18, 19 and 20 are views similar to FIGS. 10 C–E showing successive stages in the formation and filling of a bag by the FIG. 14 modification.
FIG. 21 is a view generally in section on line 21—21 of FIG. 20.

At 106 is indicated means for measuring charges of product (fluent solid product) to be packaged and delivering each charge into the tube 102 at the upper end of the tube, each charge comprising a quantity of the product for filling a package. This measuring means may be any of various types well known in the art for measuring each charge by weight (net weighting it) or measuring it by volume. The measuring means is under the control of the controller 35, the latter functioning to effect operation of the measuring means to deliver a measured charge into the tube 102 during each dwell of the tubing T when the stagers 10 and sealing members 17 are in their closed position as illustrated in FIGS. 14, 16 and 17. The stagers 10, more particularly their lower front edges 24, function when closed to pinch closed the flexible tubular extension 104 of the tube 102 acting through the tubing T.

Figure 15:
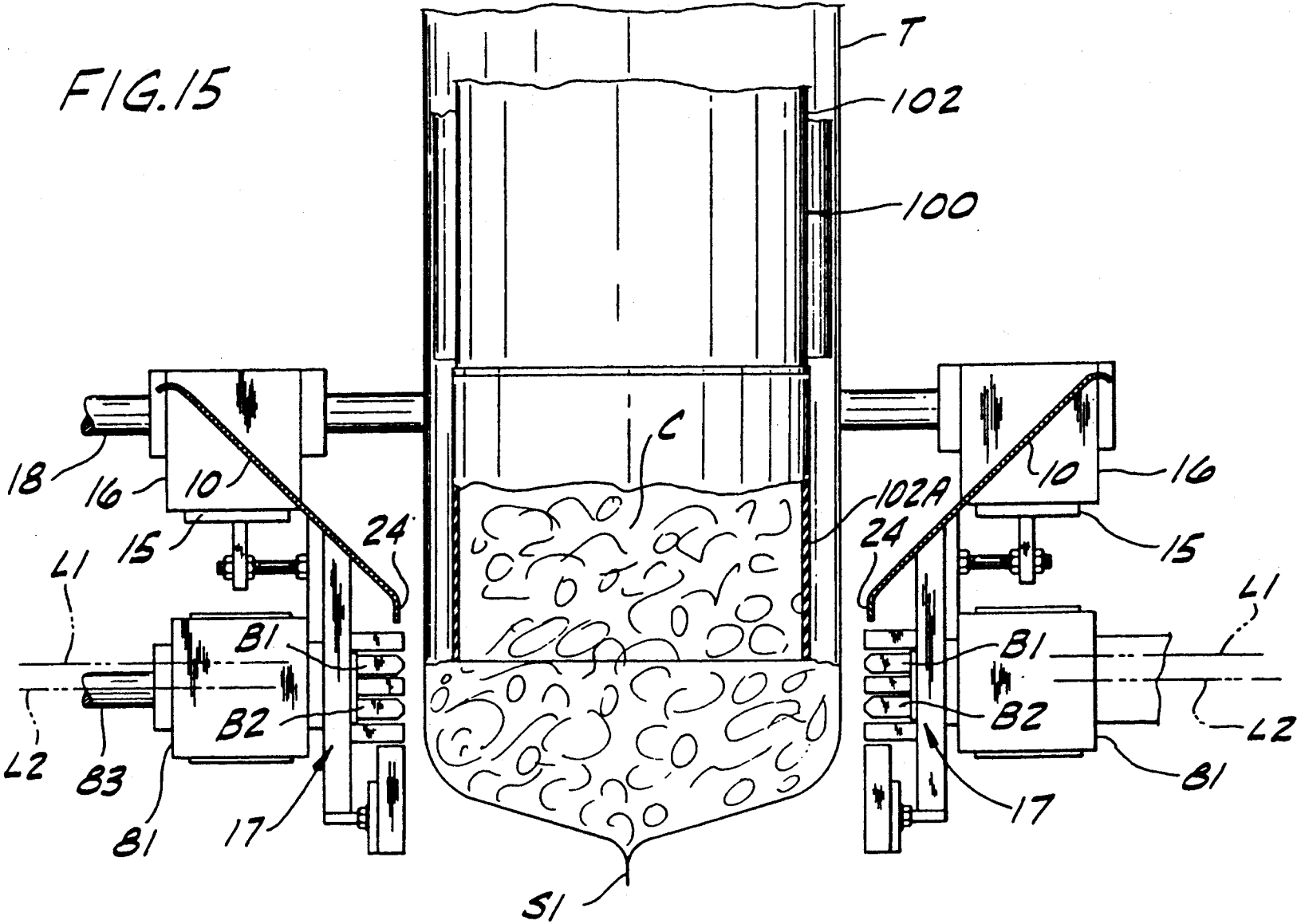
FIG. 15 is a view similar to FIG. 14 showing the sealing and staging means open and the tubing being fed downward therebetween.

A cycle of operation of the apparatus of FIGS. 14–21 may be considered as starting with the stagers 10 and sealing members 17 closed as shown in FIGS. 14, 16 and 17, the stagers 10 acting through the tubing T on the flexible tubular extension **102*a* of the filling tube 102 to pinch the extension closed, and with a measured charge C of product (as delivered by means 106) held in the tube 102 by reason of extension 102***a* being pinched closed. Under control of the programmable controller 35 as in the embodiment of FIGS. 1-8, the stagers 10 and sealing members 17 open and the tubing T is fed downwardly (by the belts 41) between the opened stagers and sealing members as illustrated in FIGS. 15 and 18. On opening of the stagers 10, the flexible tubular extension 104 at the lower end of the tube 102 is allowed to open for delivery of the charge C of product into the lower and closed end of the tubing T. Product flows out of the lower end of the opened extension 102A on to the seal S1 at the lower end of the tubing (the bottom seal of the next package to be formed), leveling off in the tubing at the lower end of the extension 102A, i.e. at the level L1, which may be referred to as the delivery level. As the tubing T continues its downward feed (see FIG. 19), delivery of the product from the tube 102 (and its extension 102*a*) continues generally at the rate at which the volume of the portion of the tubing being fed off the lower end of the mandrel is created by the downward feed of the tubing T for bottom-up filling. The delivery of the product is completed before the downfeed of a package length increment of the tubing is completed, by reason of the quantity of product as measured out and delivered into the tube 102 being such as to fill a package short of the top seal S2 of the package. Following completion of the delivery of the product, the downward feed of the tubing is thereafter continued to complete the downfeed of one package length increment of the tubing, the product level L3 descending below the level at which the tubing is sealed by the sealing members 17 as illustrated in FIG. 20. Then the stagers 10 and the sealing members 17 close as illustrated in FIG. 21, the latter effecting the formation of the top seal S2 of the package being completed and the bottom seal S1 for the next package to be formed, the tubing being cut by the knife 71 between the seals to separate the completed package from the tubing. The stagers and the sealing members dwell in the closed position for a brief interval and during this interval the next measured charge of product is delivered by the measuring means 106 into the tube 102. Then the stagers and sealing members open, and the cycle is repeated.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. The method of bagging a fluent solid product, such as flour, comprising forming a web of flexible packaging material into tubing around a downwardly extending mandrel; intermittently feeding the tubing downwardly in bag length increments off the lower end of the mandrel with a dwell between each successive feed; transversely sealing the tubing at a level below the lower end of the mandrel during each dwell to form a top seal for a bag being completed and a bottom seal for the next bag; feeding an amount of product downwardly and out of the lower end of the mandrel during the interval between the formation of the bottom seal and the top seal for a bag, the amount being such as to fill the bag to a level somewhat below the top seal; and severing the tubing between each top and bottom seal; characterized in that, during each feed cycle, the tubing is fed downwardly off the lower end of the mandrel at a predetermined rate such that a predetermined volume of tubing is generated in a unit interval of time and in that product is fed downwardly and out of the lower end of the mandrel into the tubing at a predetermined rate so related to the rate of feed of the tubing that a predetermined volume of product substantially equal to said predetermined volume of tubing is fed into the tubing in said unit interval of time, wherein the web is fed from a supply to the mandrel and is provided at bag length intervals with air vents, one for each bag, along its path of travel from the supply to the mandrel, and wherein the air vents are provided by provided at least open opening in the web at a first station along the path of the web during each dwell of the web, the openings recurring at bag lengths intervals, and applying a path of filter material to the web over each opening at a second station downstream from the first, the web being formed into the tubing with the patches on the inside of the tubing.

2. The method of bagging product comprising forming a web of flexible packaging material into tubing around a downwardly extending mandrel; intermittently feeding the tubing downwardly in bag length increments off the lower end of the mandrel with a dwell between each successive feed; transversely sealing the tubing at a level below the lower end of the mandrel during each dwell to form a top seal for a bag being completed and a bottom seal for the next bag; feeding an amount of product downwardly and out of the lower end of the mandrel during the interval between the formation of the bottom seal and the top seal for a bag, the amount being such as to fill the bag to a lever somewhat below the top seal; and severing the tubing between each top and bottom seal; characterized in that the tubing is provided at bag length intervals with air vents, one for each bag, along its path of travel to the mandrel, and the air vents are provided by providing at least one opening in the web at a first station along the path of the web during each dwell of the web, the openings recurring at bag length intervals, and applying a path of filter material to the web over each opening at a second station downstream from the first, the web being formed into the tubing with the patches on the inside of the tubing.

3. Apparatus for bagging a fluent solid product, such as flour, comprising:

a downwardly extending mandrel;

means for forming a web of flexible packaging material into tubing around the mandrel;

means operable intermittently to feed the tubing in bag length increments off the lower end of the mandrel with a dwell between each successive feed;

means for transversely sealing the tubing at a level below the lower end of the mandrel during each dwell to form a top seal for a bag being completed and a bottom seal for the next bag;

means operable to feed an amount of product downwardly and out of the lower end of the mandrel during the interval between the formation of the bottom seal of the bag and the formation of the top seal of the bag, the amount being such as to fill the bag to a level somewhat below the top seal;

means for severing the tubing between each top and bottom seal; characterized in having means for operating the tubing feeding means for feeding the tubing downwardly off the lower end of the mandrel during each feed cycle at a predetermined rate such that a predetermined volume of tubing is generated in a unit interval of time; and means for operating the product feed means to feed product downwardly and out of the lower end of the mandrel at a predetermined rate so related to the rate of feed of the tubing that a predetermined volume of product substantially equal to said predetermined volume of tubing is fed into the tubing in said unit interval of time, the web being fed from a supply to the mandrel, and means for providing the web with air vents at bag length intervals along the path of travel of the web from the supply to the mandrel, and wherein the means for providing the web with the air vents comprises means at a first station along the path of the web operable during each dwell of the web to form at least one opening in the web, the openings recurring at bag length intervals, and means for applying a patch of filter material to the web over each opening at a second station downstream from the first, the web being formed into the tubing with the patches on the inside of the tubing.

4. Apparatus for bagging product comprising:

a downwardly extending mandrel;

means for forming a web of flexible packaging material into tubing around the mandrel;

means operable intermittently to feed the tubing in bag length increments off the lower end of the mandrel with a dwell between each successive feed;

means for transversely sealing the tubing at a level below the lower end of the mandrel during each dwell to form a top seal for a bag being completed and a bottom seal for the next bag;

means operable to feed an amount of product downwardly and out of the lower end of the mandrel during the interval between the formation of the bottom seal of the bag and the formation of the top seal of the bag, the amount being such as to fill the bag to a level somewhat below the top seal; and means for severing the tubing between each top and bottom seal;

characterized in having means for providing the web with air vents at bag length intervals along the path of travel of the web from the supply to the mandrel, comprising means at a first station along the path of the web operable during each dwell of the web to form at least one opening in its web, the openings recurring at bag length intervals, and means for applying a path of filter material to the web over each opening at a second stream downstream from the first, the web being formed into the tubing with the patches on the inside of the tubing.

5. The method of packaging a fluent product comprising:

forming a web of flexible packaging material into tubing around a downwardly extending mandrel;

intermittently feeding the tubing downwardly in package length increments off the lower end of the mandrel at a predetermined rate of feed with a dwell between each successive feed;

transversely sealing the tubing at a level below the lower end of the mandrel during each dwell to form a top seal for a package being completed and a bottom seal for the next package;

severing the tubing between each top and bottom seal during each dwell;

providing product for delivery downwardly out of the lower end of the mandrel into the lower end portion of the tubing which is sealed at the bottom and extends down off the lower end of the mandrel, with the product generally held during each dwell against flowing downwardly into said lower end portion of the tubing until product delivery starts;

effecting delivery of product into said lower end portion of the tubing during the downward feed of the tubing, the volume rate of delivery being so related to the volume rate of feed of the tubing as substantially to fill the volume of said portion of the tubing as it is created by the downward feed of the tubing; and continuing the product feed until the desired volume and level of fill relative to the final package length are achieved.

6. The method of claim 5 wherein product is provided in a filling tube which extends down within the mandrel generally to the lower end of the mandrel with the lower end of the filling tube adjacent the said sealing level.

7. The method of claim 6 wherein the product is fed downwardly by rotating an auger which extends down within the filling tube generally to the lower end of the mandrel, the auger being rotated at such speed as to auger product downwardly and out of the lower end of the tube at said predetermined rate of product feed.

8. The method of claim 7 wherein for each package being formed the auger is started before the feed of the tubing and an amount of product is initially fed into the tubing such as to bring the level of product in the tubing up to a level relatively closely adjacent and just below the lower end of the mandrel, that level of product being substantially maintained as the tubing is fed downwardly and until the amount of product for filling the package has been delivered, the auger then being stopped and the downward feed of the tubing being continued until the feed of the package length has been completed and the product level is below the said level at which the tubing is sealed.

9. The method of claim 6 wherein charges of the product to be packaged, each charge comprising a quantity for filling a package short of the top seal of the package, are measured out during intervals between successive downward feeds of the tubing and each charge is held within the filling tube adjacent its lower end for delivery into the tubing on an ensuing downward feed of the tubing one package length increment.

10. The method of claim 9 wherein the charge is delivered into the tubing at a level above and closely adjacent said transverse sealing level so that the charge feeds down into the tubing at said rate for substantially filling the volume of said portion of the tubing created by the downward feed of the tubing.

11. The method of claim 10 wherein for each package being formed product is delivered during the downward feed of the tubing, the level of product in the tubing being maintained at said delivery level until the delivery of the charge is completed, downward feed of the tubing being thereafter continued and the product level descending below the said level at which the tubing is sealed.

12. The method of claim 5 wherein for each package being formed the feed of the product is started before the feed of the tubing and an amount of product is initially fed into the tubing such as to bring the level of product in the tubing up to a level relatively closely adjacent and just below the lower end of the mandrel, that level of product being substantially maintained as the tubing is fed downwardly and until the amount of product for filling the package has been delivered, the delivery of product then being terminated and the downward feed of the tubing being continued until the feed of the package length has been completed and the product level is below the said level at which the tubing is sealed.

13. The method of claim 5 wherein the web is fed from a supply to the mandrel and is provided at bag length intervals with air vents, one for each bag, along its path of travel from the supply to the mandrel.

14. The method of packaging a fluent product comprising:

forming a web of flexible packaging material into tubing around a downwardly extending mandrel;

intermittently feeding the tubing downwardly in package length increments off the lower end of the mandrel at a predetermined rate of feed with a dwell between each successive feed;

transversely sealing the tubing at a level below the lower end of the mandrel during each dwell to form a top seal for a package being completed and a bottom seal for the next package;

severing the tubing between each top and bottom seal during each dwell;

providing product for delivery downwardly out of the lower end of the mandrel into the lower end portion of the tubing which is sealed at the bottom and extends down off the lower end of the mandrel, with the product generally held during each dwell against flowing downwardly into said lower end portion of the tubing until product delivery starts;

effecting delivery of product into said lower end portion of the tubing during the downward feed of the tubing, the delivery being at a rate so related to the rate of feed of the tubing as substantially to fill the volume of said portion of the tubing created by the downward feed of the tubing; and continuing the product feed until the desired volume and level of fill relative to the final package length are achieved;

the web being fed from a supply to the mandrel and being provided at bag length intervals with air vents, one for each bag, along its path of travel from the supply to the mandrel, the air vents being provided by providing at least one opening in the web at a first station along the path of the web during each dwell of the web, the openings recurring at bag length intervals, and applying a patch of filter material to the web over each opening at a second station downstream from the first, the web being formed into the tubing with the patches on the inside of the tubing.

15. Apparatus for packaging a fluent product comprising:

a downwardly extending mandrel;

means for forming a web of flexible packaging material into tubing around the mandrel;

means for intermittently feeding the tubing downwardly in package length increments off the lower end of the mandrel at a predetermined rate of feed with a dwell between each successive feed;

means for transversely sealing the tubing at a level below the lower end of the mandrel during each dwell to form a top seal for a package being completed and a bottom seal for the next package;

means for severing the tubing between each top and bottom seal during each dwell; and means for providing product for delivery downwardly out of the lower end of the mandrel into the lower end portion of the tubing which is sealed at the bottom and extends down off the lower end of the mandrel, with the product generally held during each dwell against flowing downwardly into said lower end portion of the tubing until product delivery starts; and means for effecting delivery of product into said lower end portion of the tubing during the downward feed of the tubing, the volume rate of delivery being so related to the volume rate of feed of the tubing as substantially to fill the volume of said portion of the tubing as it is created by the downward feed of the tubing, and continuing the product feed until the desired volume and level of fill relative to the final package length are achieved.

16. Apparatus as set forth in claim 15 wherein the means for providing for delivery comprises a filling tube which extends down within the mandrel generally to the lower end of the mandrel with the lower end of the filling tube adjacent the said sealing level.

17. Apparatus as set forth in claim 16 wherein the product delivery means comprises an auger in the filling tube, said apparatus having means for rotating the auger at such speed as to auger product downwardly and out of the lower end of the mandrel at said predetermined rate of product feed.

18. Apparatus as set forth in claim 17 having means operable in respect to each package being formed for starting the auger before the start of the tubing feeding means and effecting operation of the auger until an amount of product is initially fed into the tubing such as to bring the level of product in the tubing up to a level relatively closely adjacent and just below the lower end of the mandrel and continuing the operation of the auger substantially to maintain that level of product until the amount of product for filling the package has been delivered, and then terminating the operation of the auger, the means for feeding the tubing downwardly continuing in operation after the termination of operation of the auger and until the product level is below the level of the sealing means.

19. Apparatus as set forth in claim 15 wherein the product delivery means comprises means for holding within the filling tube a measured charge of product to be packaged, each charge comprising a quantity for filling the package short of the top seal of the package, and for delivery in the charge into the tubing on said ensuing downward feed of the tubing one package length interval.

20. Apparatus as set forth in claim 19 wherein the filling tube extends vertically within and downwardly out of the lower end of the mandrel to a level above and closely adjacent said sealing level and has means for closing its lower end to hold the charge therein, said closing means being opened during the downward feed of the tubing for delivery of the charge.

21. Apparatus as set forth in claim 15 having means operable in respect to each package being formed for starting the product delivery means before the start of the tubing feeding means and effecting operation of the product delivery means until an amount of product is initially fed into the tubing such as to bring the level of product in the tubing up to a level relatively closely adjacent and just below the lower end of the mandrel and continuing the operation of the product delivery means substantially to maintain that level of product until the amount of product for filling the package has been delivered, and then terminating the operation of the product delivery means, the means for feeding the tubing downwardly continuing in operation after the termination of operation of the product delivery means and until the product level is below the level of the sealing means.

22. Apparatus as set forth in claim 15 wherein the web is fed from a supply to the mandrel, and having means for providing the web with air vents at bag length intervals along the path of travel of the web from the supply to the mandrel.

23. Apparatus for packaging a fluent product comprising:

a downwardly extending mandrel;

means for forming a web of flexible packaging material into tubing around the mandrel;

means for intermittently feeding the tubing downwardly in package length increments off the lower end of the mandrel at a predetermined rate of feed with a dwell between each successive feed;

means for transversely sealing the tubing at a level below the lower end of the mandrel during each dwell to form a top seal for a package being completed and a bottom seal for the next package;

means for severing the tubing between each top and bottom seal during each dwell; and means for providing product for delivery downwardly out of the lower end of the mandrel into the lower end portion of the tubing which is sealed at the bottom and extends down off the lower end of the mandrel, with the product generally held during each dwell against flowing downwardly into said lower end portion of the tubing until product delivery starts; and means for effecting delivery of product into said lower and portion of the tubing during the downward feed of the tubing, the delivery being at a rate so related to the rate of feed of the tubing as substantially to fill the volume of said portion of the tubing created by the downward feed of the tubing, and continuing the product feed until the desired volume and level of fill relative to the first package length are achieved.

the web being fed from a supply to the mandrel, and wherein the apparatus further comprises means for providing the web with air vents at bag length intervals along the path of travel of the web from the supply to the mandrel, the means for providing the web with the air vents comprising means at a first station along the path of the web operable during each dwell of the web to form at least one opening in its web, the openings recurring at bag length intervals, and means for applying a patch of filter material to the web over each opening at a second station downstream from the first, the web being formed into the tubing with the patches on the inside of the tubing.

24. Apparatus for packaging a fluent product comprising:

a downwardly extending mandrel;

means for forming a web of flexible packaging material into tubing around the mandrel;

means for intermittently feeding the tubing downwardly in package length increments off the lower end of the mandrel at a predetermined rate of feed with a dwell between each successive feed;

means for transversely sealing the tubing at a level below the lower end of the mandrel during each dwell to form a top seal for a package being completed and a bottom seal for the next package;

means for severing the tubing between each top and bottom seal during each dwell; and means for providing product for delivery downwardly out of the lower end of the mandrel into the lower end portion of the tubing which is sealed at the bottom and extends down off the lower end of the mandrel, with the product generally held during each dwell against flowing downwardly into said lower end portion of the tubing until product delivery starts; and means for effecting delivery of product into said lower end portion of the tubing during the downward feed of the tubing, the delivery being at a rate so related to the rate of feed of the tubing as substantially to fill the volume of said portion of the tubing created by the downward feed of the tubing, and continuing the product feed until the desired volume and level of fill relative to the first package length are achieved;

the product delivery means comprising means for holding within the filling tube a measured charge of product to be packaged, each charge comprising a quantity for filling the package short of the top seal of the package, and for delivering the charge into the tubing on said ensuing downward feed of the tubing one package length interval;

the filling tube extending vertically within and downwardly out of the lower end of the mandrel to a level above and closely adjacent said sealing level and has means for closing its lower end to hold the charge therein, said closing means being opened during the downward feed of the tubing for delivery of the charge;

means for pinching the tubing closed between the lower end of the mandrel and said sealing level during each dwell, said closing means for the tube being operable by said pinching means for the tubing.

25. Apparatus as set forth in claim 24 wherein said closing means for the tube comprises a flexible tubular extension of said tube at its lower end which is pinched closed by said pinching means acting through the tubing when the pinching means closes on the tubing.

26. The method of packaging a fluent product comprising:

forming a web of flexible packaging material into tubing around a downwardly extending mandrel;

intermittently feeding the tubing downwardly in package length increments off the lower end of the mandrel at a predetermined rate of feed with a dwell between each successive feed;

transversely sealing the tubing at a level below the lower end of the mandrel during each dwell to form a top seal for a package being completed and a bottom seal for the next package;

severing the tubing between each top and bottom seal during each dwell;

measuring charges of product to be packaged and holding each charge in a filling tube within the mandrel for delivery into the tubing on an ensuing downward feed of the tubing one package length increment;

delivering each charge downwardly from the filling tube into the portion of the tubing sealed at the bottom being fed off the lower end of the mandrel at a volume rate so related to the volume rate of feed of the tubing as substantially to fill the volume of said portion of the tubing as it is created by the downward feed of the tubing; and continuing the delivery of the charge until it has all been delivered into the tubing, the delivery of the charge being completed before the downfeed of the tubing through a package length increment is completed.

27. The method of claim 26 wherein the charge is delivered into the tubing at a level above and closely adjacent said transverse sealing level so that the charge feeds down into the tubing at said rate for substantially filling the volume of said portion of the tubing created by the downward feed of the tubing.

28. The method of claim 27 wherein for each package being formed product is delivered during the downward feed of the tubing, the level of product in the tubing being maintained at said delivery level until the delivery of the charge is completed, downward feed of the tubing being thereafter continued and the product level descending below the said level at which the tubing is sealed.

29. Apparatus for packaging a fluent product comprising:

a downwardly extending mandrel;

means for forming a web of flexible packaging material into tubing around the mandrel;

means for intermittently feeding the tubing downwardly in package length increments off the lower end of the mandrel at a predetermined rate of feed with a dwell between each successive feed;

means for transversely sealing the tubing at a level below the lower end of the mandrel during each dwell to form a top seal for a package being completed and a bottom seal for the next package;

means for severing the tubing between each top and bottom seal during each dwell;

means for measuring charges of product to be packaged; and means comprising a filling tube within the mandrel for holding each charge for delivery into the tubing on an ensuing downward feed of the tubing one package length increment, delivering each charge downwardly into the portion of the tubing sealed at the bottom being fed off the lower end of the mandrel at a volume rate so related to the volume rate of feed of the tubing as substantially to fill the volume of said portion of the tubing as it is created by the downward feed of the tubing; and continuing the delivery of the charge until it has all been delivered into the tubing, the delivery of the charge being completed before the down feed of the tubing through a package length increment is completed.

30. Apparatus as set forth in claim 29 wherein said filling tube is disposed to deliver the charge into the tubing at a level above and closely adjacent said transverse sealing level so that the charge feeds down into the tubing at said rate for substantially filling the volume of said portion of the tubing created by the downward feed of the tubing.

31. Apparatus as set forth in claim 30 wherein for each package being formed said means for holding and delivering the charge is operable to deliver product as the tubing is fed downwardly, the level of product in the tubing being maintained at said delivery level until the delivery of the charge is completed, downward feed of the tubing being thereafter continued and the product level descending below the said level at which the tubing is sealed.

32. Apparatus as set forth in claim 30 wherein said tube extends vertically within and downwardly out of the lower end of the mandrel to a level above and closely adjacent said sealing level and having means for closing its lower end to hold the charge therein, said closing means being opened on the downward feed of the tubing for delivery of the charge.

33. Apparatus for packaging a fluent product comprising:

a downwardly extending mandrel;

means for forming a web of flexible packaging material into tubing around the mandrel;

means for intermittently feeding the tubing downwardly in package length increments off the lower end of the mandrel at a predetermined rate of feed with a dwell between each successive feed;

means for transversely sealing the tubing at a level below the lower end of the mandrel during each dwell to form a top seal for a package being completed and a bottom seal for the next package;

means for severing the tubing between each top and bottom seal during each dwell;

means for measuring charges of product to be packaged;

means comprising a filling tube within the mandrel for holding each charge for delivery into the tubing on an ensuing downward feed of the tubing one package length increment, delivering each charge downwardly into the portion of the tubing sealed at the bottom being fed off the lower end of the mandrel at a rate so related to the rate of feed of the tubing as substantially to fill the volume of said portion of the tubing created by the downward feed of the tubing; and continuing the delivery of the charge until it has all been delivered into the tubing, the delivery of the charge being completed before the down feed of the tubing through a package length increment is completed;

said filling tube being disposed to deliver the charge into the tubing at a level above and closely adjacent said transverse sealing level so that the charge feeds down into the tubing of said rate for substantially filling the volume of said portion of the tubing created by the downward feed of the tubing;

said tube extending vertically within and downwardly out of the lower end of the mandrel to a level above and closely adjacent said sealing level and having means for closing its lower end to hold the charge therein, said closing means being opened on the downward feed of the tubing for delivery of the charge;

means for pinching the tubing closed between the closed end of the mandrel and said sealing level during each dwell, said closing means for the tube being operable by said pinching means for the tubing.

34. Apparatus as set forth in claim 33 wherein said closing means for the tube comprises a flexible tubular extension of said tube at its lower end which is pinched closed by said pinching means acting through the tubing when the pinching means closes on the tubing.

35. Apparatus for packaging a fluent product comprising:

a downwardly extending mandrel;

means for forming a web of flexible packaging material into tubing around the mandrel;

means for intermittently feeding the tubing downwardly in package length increments off the lower end of the mandrel at a predetermined rate of feed with a dwell between each successive feed;

means for transversely sealing the tubing at a level below the lower end of the mandrel during each dwell to form a top seal for a package being completed and a bottom seal for the next package;

means for severing the tubing between each top and bottom seal during each dwell;

a tube extending vertically within and downwardly out of the lower end of the mandrel to a level above and closely adjacent said sealing level and having means for closing its lower end to hold the charge therein, said closing means being opened on the downward feed of the tubing for delivery of the charge; and means for pinching the tubing closed between the lower end of the mandrel and said sealing level during each dwell, said closing means for the tube being operable by said pinching means for the tubing.

36. Apparatus as set forth in claim 35 wherein said closing means for the tube comprises a flexible tubular extension of said tube at its lower end which is pinched closed by said pinching means acting through the tubing when the pinching means closes on the tubing.

* * * * *

UNITED STATES PATENT AND TRADEMARK OFFICE
CERTIFICATE OF CORRECTION

PATENT NO. : 5,014,493

DATED : May 14, 1991

INVENTOR(S) : George A. West

It is certified that error appears in the above-identified patent and that said Letters Patent is hereby corrected as shown below:

Column 14, claim 1, line 17, "open opening" should read ---one opening---.

Column 14, claim 1, line 19, "path" should read ---patch---.

Column 14, claim 2, line 37, "lever" should read ---level---.

Column 14, claim 2, line 45, "path" should read ---patch---.

Column 15, claim 4, line 55, "path" should read ---patch---.

Column 15, claim 4, line 56, "second stream downstream" should read ---second station downstream---.

Column 18, claim 16, line 27, "providing for" should read ---providing product for---.

Column 18, claim 19, line 57, "delivery in the" should read ---delivering the---.

Column 22, claim 33, line 54, "tubing of said" should read ---tubing at said---.

UNITED STATES PATENT AND TRADEMARK OFFICE

CERTIFICATE OF CORRECTION

PATENT NO. : 5,014,493

DATED : May 14, 1991

INVENTOR(S) : George A. West

It is certified that error appears in the above-indentified patent and that said Letters Patent is hereby corrected as shown below:

Col. 22, claim 33, line 65, "closed end" should read --lower end--.

Signed and Sealed this

Twenty-sixth Day of July, 1994

*Attest:*

*Attesting Officer*

BRUCE LEHMAN

*Commissioner of Patents and Trademarks*